US005300416A

United States Patent [19]

Yamanouchi et al.

[11] Patent Number: 5,300,416

[45] Date of Patent: Apr. 5, 1994

[54] SILVER HALIDE PHOTOGRAPHIC LIGHT-SENSITIVE MATERIAL

[75] Inventors: Junichi Yamanouchi; Satoru Toda; Nobuaki Ohmori; Yuichi Ohashi, all of Kanagawa, Japan

[73] Assignee: Fuji Photo Film Co., Ltd., Kanagawa, Japan

[21] Appl. No.: 910,394

[22] Filed: Jul. 8, 1992

[30] Foreign Application Priority Data

Jul. 9, 1991 [JP] Japan ..... 3-193596

[51] Int. Cl.[5] ..... G03C 1/85

[52] U.S. Cl. ..... 430/529; 430/527; 430/936

[58] Field of Search ..... 430/529, 527, 536

[56] References Cited

U.S. PATENT DOCUMENTS 5,104,779 4/1992 Saverin et al. ..... 430/529

FOREIGN PATENT DOCUMENTS 61-296352 12/1986 Japan .

64-91132 4/1989 Japan .

*Primary Examiner*—Jack P. Brammer

*Attorney, Agent, or Firm*—Sughrue, Mion, Zinn, Macpeak & Seas

[57] ABSTRACT

There is disclosed a silver halide photographic light-sensitive material which is improved in an antistatic property, curling before and after processing, and surface status after processing. The light-sensitive material includes a support having provided thereon at least one light-sensitive silver halide emulsion layer, wherein the material contains an anionic crosslinked polymer dispersion containing a polymer represented by Formula (I), and the material further contains an anionic water soluble polymer represented by Formula (II):

Formula (I)

Formula (II)

wherein A represents a repetitive unit formed by copolymerizing a crosslinking monomer having at least two copolymerizable ethylenically unsaturated groups; B and E each represent a monomer unit formed by copolymerizing copolymerizable ethylenically unsaturated monomers; $R^1$ represents a hydrogen atom, a substituted or unsubstituted lower alkyl group, or a halogen atom; L represents a di- to tetravalent linkage group; M represents a hydrogen atom or a cation; m represents 0 or 1; n represents 1, 2 or 3; D represents a monomer unit formed by copolymerizing at least one monomer selected from the group consisting of N,N-dimethylacrylamide, N-acryloylmorpholine and N-acryloylpiperidine; x, y, z, x', y', and z' each represent a percentage of a monomer component, provided that x is from 1 to 70, y is from 0 to 50, z is from 25 to 90, x' is from 1 to 99, y' is from 0 to 50, and z' is from 1 to 99, wherein $x+y+z=100$ and $x'+y'+z'=100$.

10 Claims, No Drawings

SILVER HALIDE PHOTOGRAPHIC LIGHT-SENSITIVE MATERIAL

FIELD OF THE INVENTION

The present invention relates to a silver halide photographic light-sensitive material. Specifically, the present invention relates to a silver halide photographic light-sensitive material which is improved in an antistatic property, curling before and after processing, and surface status after processing.

BACKGROUND OF THE INVENTION

A photographic light-sensitive material comprising a support and a photographic layer is liable to have a static charge accumulated thereon by contact friction with or peeling from a similar or different material during manufacture and use. This accumulated static charge causes many troubles. The most serious trouble is that a static charge accumulated before processing is discharged to sensitize a light-sensitive layer and form dot-like spot or dendritic and plumose line speckles when subjecting a photographic film to development processing.

This is a so-called static mark, and it markedly damages the commercial value of a photographic film. In some cases, the commercial value is completely lost. This phenomenon does not become clear until development is carried out and accordingly is a very troublesome problem. Further, this accumulated static charge causes secondary problems such as dust sticking on a film surface and difficulty in obtaining uniform coating.

As described above, such static charge is often accumulated during the manufacture and use of a photographic light-sensitive material. It is generated by, for example, the frictional contact of a photographic film with a roller and the peeling of an emulsion layer from a support during the steps of winding and rewinding of a photographic film. Further, the static charge is generated due to peeling of an X-ray film by contact with a machine part in an automatic camera or a fluorescent sensitive paper. In addition, it is generated by contact with a packaging material.

Static marking of a photographic material, which is caused by an accumulated static charge, is increased by the increase in the sensitivity and processing speed of a photographic light-sensitive material. Especially in recent years, the inclination toward high sensitivity for a photographic light-sensitive material and the increased chances to have the severe handling such as high speed coating, high speed photographing and high speed automatic development processing further accelerates the generation of static marking.

In order to remove the problems caused by a static charge, an antistatic agent is preferably added to a photographic light-sensitive material. However, the antistatic agents generally used in other fields cannot necessarily be applied as antistatic agents for a photographic light-sensitive material, since they must satisfy various requirements which are specific to a photographic light-sensitive material. That is, an antistatic agent which can be applied to a photographic light-sensitive material must have, for example, no bad influence on photographic properties such as the sensitivity of a photographic light-sensitive material, fog, graininess and sharpness, no bad influence on the layer strength of a photographic light-sensitive material (that is, no liability that a light-sensitive material is scratched by rubbing and scratching), no bad influence on anti-adhesiveness (that is, no liability that the surfaces themselves of the photographic light-sensitive materials or the surface thereof and that of another material are adhered), no acceleration of the deterioration of a processing solution used for a photographic light-sensitive material, and no deterioration of the adhesion strength between the respective component layers. Thus, the application of the antistatic agent is subjected to many limitations.

One method for eliminating the problems caused by a static charge is to increase the electroconductivity of the surface of a photographic light-sensitive material to discharge the static charge after only a short period of time (i.e., before an accumulated static charge is discharged). Accordingly, methods for increasing the electroconductivity of a support and various coated surface layers have previously been considered, and one method which has been tried is to utilize an ionic polymer.

The attempts to apply an anionic polymer having a carboxyl group for preventing a static charge in a photographic light-sensitive material are disclosed, for example, in JP-B-57-53587 (the term "JP-B" as used herein means an examined Japanese patent publication), and JP-B-57-15375, German Patent 1,745,061, JP-B-49-23827, JP-B-55-14415, and JP-B-55-15267, JP-A-48-89979 (the term "JP-A" as used herein means an unexamined published Japanese Patent Application), U.S. Pat. Nos. 2,279,410 and 3,791,831, and JP-B-47-28937.

However, these polymers are water soluble, and problems arise when a silver halide photographic light-sensitive material in which these polymers are present in an amount sufficient for obtaining a necessary antistatic property is subjected to development processing, whereby these polymers are eluted in an aqueous development processing solution and are accumulated therein to stain a silver halide photographic light-sensitive material which is subsequently subjected to development processing, and a small -elution spot remains on the silver halide photographic light-sensitive material from which the polymers were eluted to generate a cloud thereon.

Further, there has been the problem that these polymers are diffused from the layer of a silver halide photographic light-sensitive material to which these polymers are added to the other layers, so that the antistatic property is markedly lowered.

In order to solve these problems, attempts to convert these polymers to crosslinked latexes by using an ethylenically unsaturated monomer have so far been made to some extent. For example, it is disclosed in U.S. Pat. No. 4,301,240 that the conversion thereof to a crosslinked polymer is possible with the following methods (a) and (b), and it has been possible to solve the above various problems concerning the water soluble anionic polymers:

(a) the method in which acrylic acid or methacrylic acid is subjected to a reverse phase emulsion polymerization in a water-in-oil emulsion together with a crosslinking monomer in the presence of an alkali and a surface active agent to prepare a dispersion of a crosslinked polymer, and then the dispersion is broken to redisperse these polymer particles in water; and (b) the method in which a short chain aliphatic ester of acrylic acid or methacrylic acid is subjected to an emulsion polymerization in an oil-in-water emulsion (regular phase) together with a crosslinking monomer in the presence of a surface active agent, and then an alkali is added to saponify the short chain aliphatic ester portion of acrylic acid or methacrylic acid.

However, all of the above methods have the problems that the production thereof is troublesome and, in addition, that they require very expensive manufacturing costs. That is, in the method (a), a large amount of an organic solvent is needed in carrying out the reverse phase polymerization, and further the operation to break the dispersion and redisperse the polymer particles in water is necessary.

Meanwhile, in the method (b), stirring for a long time under heating at a high temperature has to be continued for saponifying a short chain aliphatic ester of acrylic acid or methacrylic acid. According to the examples of U.S. Pat. No. 4,301,240, a long time of 45 hours at a high temperature of 125° C. is needed.

Thus, the operations are troublesome in any of the above methods, and in addition, the production costs are very expensive. The increase in the production cost of a crosslinked polymer results naturally in the increase in the production cost of a photographic light-sensitive material in which the crosslinked polymer is used, and the commercial value thereof is damaged so much. Accordingly, it is strongly desired to manufacture the crosslinked polymer at an inexpensive cost.

The countermeasure against this problem is disclosed in JP-A-61-296352, in which a monomer having a carboxyl group (for example, acrylic acid and methacrylic acid) is subjected directly to an emulsion polymerization in an oil-in-water emulsion (regular phase), and then, an alkali is added to prepare a crosslinked polymer dispersion. This methods can provide a polymer having an inexpensive production cost, no problem of layer peeling, and an excellent antistatic property.

It has been found, however, that where the above material is used as an antistatic agent (particularly for a side opposite to a silver halide emulsion layer), film curling after processing becomes large, and that in case of a roller transportation type automatic developing machine, film becomes folded in some cases. A large amount of a hydrophobic crosslinking monomer is needed for preparing a crosslinked latex in a regular phase emulsion polymerization from acrylic acid and methacrylic acid, which are water soluble monomers. Accordingly, the latex particles thus prepared are highly crosslinked.

It is considered that where such an anionic latex dispersion is applied to a back layer as an antistatic agent, development processing causes curling (a curvature of the film which is generated due to the difference between the extensions of the inside and outside thereof) because of a notably small swelling rate of the back layer side against that of the silver halide emulsion layer side. A photographic light-sensitive material is needed to have no curling which is generated due to variations of temperature and humidity not only after processing but also during storage, and therefore if countermeasures such as increasing the amount of gelatin in the back layer and raising the hardening degree of the emulsion layer side are taken to prevent curling after processing, curling during storage is another problem.

Also, the reduction of a hydrophobic crosslinking monomer has the problem that while it can provide an effect for increasing the swelling rate of the layer containing an antistatic agent and preventing curling to some extent, the amount of an acid component which is converted to a crosslinked particle is reduced, and the ratio of a water soluble monomer is resultantly increased, and therefore the above problem attributable to the water soluble monomer results.

SUMMARY OF THE INVENTION

One object of the present invention is to provide a silver halide photographic light-sensitive material having a good curling property and a sufficient antistatic property.

A second object of the present invention is to provide an antistatic agent causing no problems in regard to the generation of scum in development processing and an elution trace on the surface of the light-sensitive material and providing a good layer strength when applied, and a silver halide photographic light-sensitive material containing the antistatic agent.

A third object of the present invention is to provide an antistatic agent which can readily be produced at an inexpensive production cost, and a silver halide photographic light-sensitive material containing the antistatic agent.

The above and other objects of the present invention have been achieved by a silver halide photographic light-sensitive material comprising a support having provided thereon at least one light-sensitive silver halide emulsion layer, wherein the material contains an anionic crosslinked polymer dispersion containing a polymer represented by Formula (I), and the material further contains an anionic water soluble polymer represented by Formula (II):

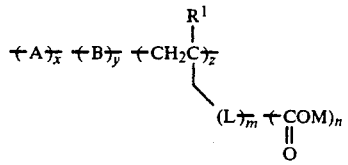

Formula (I)

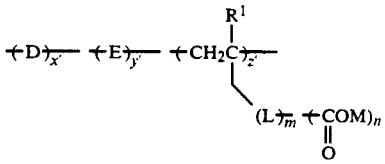

Formula (II)

wherein A represents a repetitive unit formed by copolymerizing a crosslinking monomer having at least two copolymerizable ethylenically unsaturated groups; B and E each represent a monomer unit formed by copolymerizing copolymerizable ethylenically unsaturated monomers; $R^1$ represents a hydrogen atom, a substituted or unsubstituted lower alkyl group, or a halogen atom; L represents a di- to tetravalent linkage group; M represents a hydrogen atom or a cation; m represents 0 or 1; n represents 1, 2 or 3; D represents a monomer unit formed by copolymerizing at least one monomer selected from the group consisting of N,N-dimethylacrylamide, N-acryloylmorpholine, and N-acryloylpiperidine; x, y, z, x', y', and z' each represent a percentage of a monomer component, provided that x is from 1 to 70, y is from 0 to 50, z is from 25 to 90, x' is from 1 to 99, y' is from 0 to 50, and z' is from 1 to 99, wherein $x+y+z=100$ and $x'+y'+z'=100$.

DETAILED DESCRIPTION OF THE INVENTION

The compounds represented by Formula (I) and Formula (II) will be explained in detail below.

Preferable examples of the copolymerizable ethylenically unsaturated monomer providing the repetitive unit represented by A include methylene bisacrylamide, ethylene bisacrylamide, divinylbenzene, ethylene glycol dimethacrylate, diethylene glycol dimethacrylate, triethylene glycol dimethacrylate, ethylene glycol diacrylate, diethylene glycol diacrylate, 1,6-hexanediol acrylate, neopentyl glycol dimethacrylate, and tetramethylene dimethacrylate. Among them, particularly preferred are divinylbenzene and ethylene glycol dimethacrylate.

Next, the anionic repetitive unit in Formula (I) and Formula (II) will be described below.

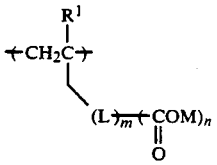

$R^1$ represents a hydrogen atom, an unsubstituted alkyl group having 1 to 4 carbon atoms such as methyl, ethyl and n-propyl, a substituted alkyl group having 1 to 4 carbon atoms such as carboxymethyl, or a halogen atom such as fluorine, chlorine and bromine. Of them, a hydrogen atom, methyl, carboxymethyl or chlorine atom is preferred.

L is a divalent, trivalent or tetravalent linkage group. Where it is the divalent linkage group, it is preferably —Q—, and where it is the trivalent or tetravalent linkage group, it is preferably:

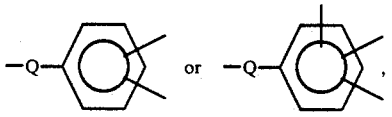

respectively, wherein Q is a divalent linkage group, examples of which include an alkylene group having 1 to 6 carbon atoms (for example, methylene, ethylene and trimethylene), an arylene group having 6 to 10 carbon atoms (for example, phenylene), —COO—X— (provided that X represents an alkylene group having 1 to about 6 carbon atoms or an arylene group, hereinafter representing the same) (for example, —$COOCH_2CH_2$—), —COO—X—OCO— (for example, —$COOCH_2CH_2OCO$—), —OCO—X— (for example, —$OCOCH_2CH_2$—), —OCO—X—COO— (for example, —$OCOCH_2CH_2CH_2CH_2COO$—), —CONH—X— (for example, —CONH—$C_6H_4$(p)—), —CONH—X—NHCO— (for example, —$CONHCH_2CH_2NHCO$—), and —CONH—X—OCO— (for example, —$CONHCH_2CH_2OCO$—).

m is 0 or 1.

n is 1, 2 or 3.

M represents a hydrogen atom or a cation.

Suitable examples of the cation include an alkali metal ion (for example, a sodium ion and a potassium ion), an ammonium ion (for example, a trimethylammonium ion, a triethylammonium ion and tributylammonium ion). Of them, the alkali metal ion is particularly preferred.

Specific examples of an anionic monomer include acrylic acid, methacrylic acid, itaconic acid, p-vinylbenzoic acid, maleic anhydride,

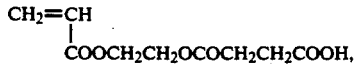

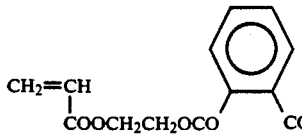

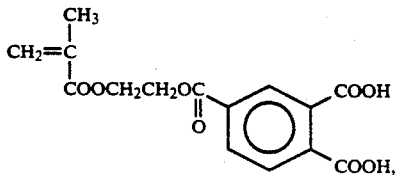

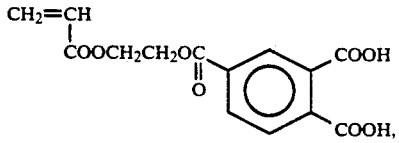

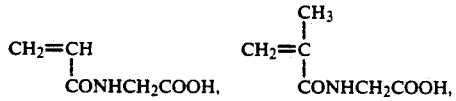

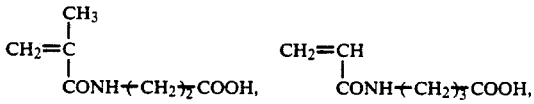

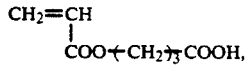

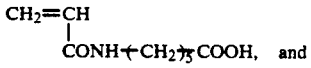

and

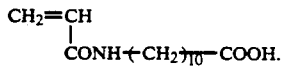

Among them, particularly preferred are the monomers which are soluble in distilled water at a room temperature.

Such particularly preferred anionic monomers include acrylic acid, methacrylic acid, itaconic acid,

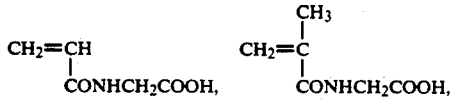

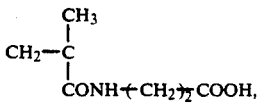

and

-continued

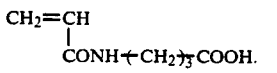

These monomers having an anionic group can be subjected to polymerization in the form of the salts thereof, for example, an alkali metal salt (for example, a sodium salt and a potassium salt), and an ammonium salt (for example, the salts with ammonia, methylamine, and dimethylamine).

The monomers contained in Formula (I) and Formula (II) and having a —COOM group may be the same or different, and each may be used in combination of two or more kinds.

Suitable examples of the ethylenically propylene, 1-butene, isobutene, styrene, α-methylstyrene, vinylketone, monoethylenically unsaturated ester of aliphatic acid (for example, vinyl acetate and allyl acetate), ethylenically unsaturated monocarboxylic acid or dicarboxylic acid ester (for example, methyl methacrylate, ethyl methacrylate, n-butyl methacrylate, n-hexyl methacrylate, cyclohexyl methacrylate, benzyl methacrylate, n-butyl acrylate, n-hexyl acrylate, and 2-ethylhexyl acrylate), a monoethylenically unsaturated compound (for example, acrylonitrile), and dienes (for example, butadiene and isoprene), but it is not limited thereto.

As the ethylenically unsaturated monomer represented by E, the above ethylenically unsaturated monomers represented by B may be used as long as the water solubility of the polymer represented by Formula (II) is not deteriorated and the antistatic property and curling property are not deteriorated. Particularly preferred is a monomer soluble in distilled water.

Such monomers include acrylamides such as acrylamide, methacrylamide, n-methyl acrylamide, and N-methacryloyl morpholine, N-vinyl cyclic compounds such as N-vinylpyrrolidone and N-vinyl caprolactam, esters of acrylic acid or methacrylic acid such as 2-hydroxyethyl acrylate, 2-hydroxyethyl methacrylate, 2-hydroxypropyl methacrylate, 2-methoxyethyl acrylate,

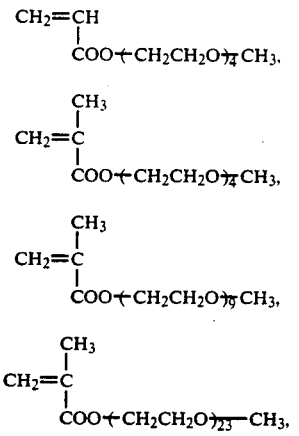

and 2-methanesulfonamidethyl acrylate, and a monomer having an anionic functional group other than a —COOH group, such as 2-acrylamide-2-methylpropanesulfonic acid and the salt thereof, a styrenesulfonic acid salt, and a styrenesulfinic acid salt.

D represents a monomer unit formed by copolymerizing at least one monomer selected from the group consisting of N,N-dimethyl acrylamide, N-acryloylmorpholine and N-acryloylpiperidine.

x, y, z, x', y', and z' represent a percentage of each monomer component. x is 1 to 70, preferably 10 to 60, y is 0 to 50, preferably 0 to 30, z is 25 to 90, preferably 50 to 90, x' is 1 to 99, preferably 5 to 95, y' is 0 to 50, preferably 0 to 30, and z' is 1 to 99, preferably 5 to 95, wherein $x+y+z=100$ and $x'+y'+z'=100$.

The method for preparing the dispersion of the polymer represented by Formula (I) will be explained below.

The compound represented by Formula (I) can be synthesized by copolymerizing the copolymerizable monomers having at least two of the above ethylenically unsaturated groups represented by A, and according to necessity, the ethylenically unsaturated monomer represented by B and the ethylenically unsaturated monomer having at least one anionic functional group by a generally well known emulsion polymerization method. Particularly preferred is the method in which a monomer and a polymerization initiator are simultaneously added to heated water. This method is described in detail in JP-A-61-296352.

As a polymerization initiator, a conventional radical polymerization initiator can be used. Particularly preferred is a water soluble initiator.

As the water soluble initiator, persulfates and azo type compounds are known. Persulfates such as potassium persulfate can provide particularly excellent results. The amount of the polymerization initiator used is 0.05 to 5% by weight, preferably 0.1 to 1.0% by weight, based on the amount of a monomer.

Because the anionic crosslinked polymer prepared has a charge and is present in a comparatively stable dispersion in water, no surface active agents have to be added to the water in many cases. However, a surface active agent can be added supplementally to stabilize the dispersing condition of the anionic crosslinked polymer in water. Examples of the surface active agent which can be used in the present invention are given below, but the surface active agent is not limited thereto.

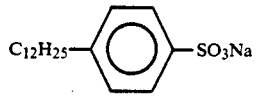

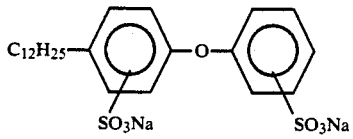

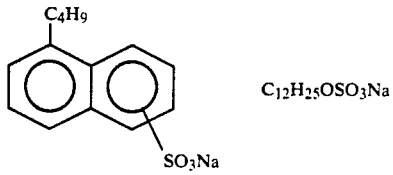

-continued

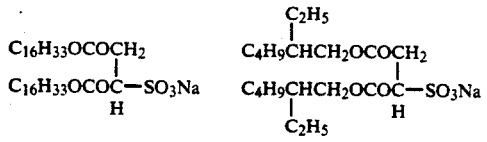

The polymerization temperature is one of the important manufacturing conditions. The polymerization is usually carried out at a temperature of 50° to 80° C. in many cases. In case of the compound of Formula (I), it is possible to carry out the polymerization at 50° to 80° C., but it will be impossible to prepare a coated material with a good surface property without completely removing the flocculates not dispersible and insoluble in water and an organic solvent, which are by-products produced in a large amount under such conditions. The removal of such flocculates leads to an increase in the price of the anionic crosslinked polymer itself attributable to the cost for removing the flocculates and the reduction in yield, and therefore the higher the polymerization temperature, the more preferable.

However, because of the limitation of polymerization carried out in water, the polymerization is usually carried out preferably at 85° to 98° C. Also, the polymerization at a higher temperature might be possible with an improvement in polymerization equipment.

Where an anionic functional group in the polymer is used in the form of a salt, the monomer may be polymerized in the form of a salt, or a base compound may be added after the polymerization. A particularly preferred method is to add a base after the polymerization. Of the the polymer dispersion finally obtained containing a polymer represented by Formula (I), the ratio in which M takes the salt structure of an alkali metal or a ammonium ion in the polymer dispersion can be 70 to 100 mole % based on the mole of the whole —COOM group.

Examples of the polymers of the present invention represented by Formula (I) and the syntheses thereof are shown below, but the present invention is not limited thereto. The copolymerization ratio described in the polymerization examples is shown in terms of a percentage by weight. The ratio of M is shown in terms of a molar ratio.

P-1,2

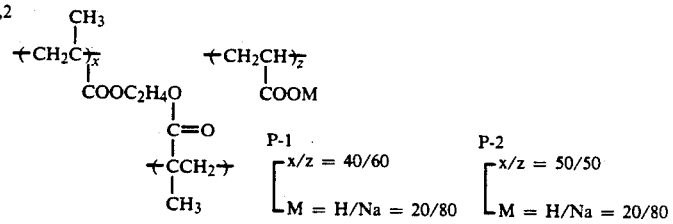

P-3

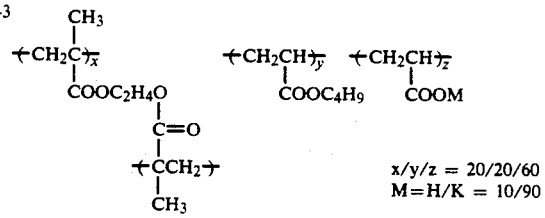

P-4,5

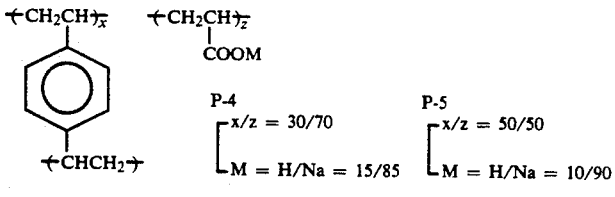

P-6

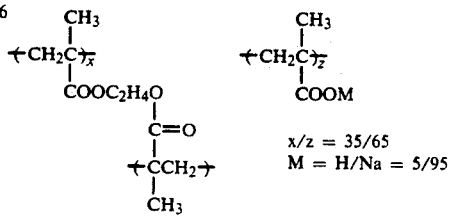

-continued

P-7

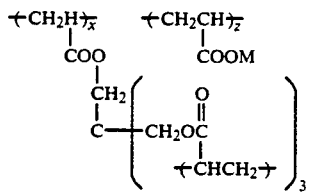

x/z = 50/50
M = H/Na = 10/90

P-8

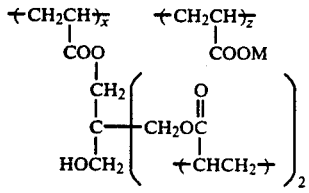

x/z = 40/60
M = H/$NH_4$ = 5/95

P-9

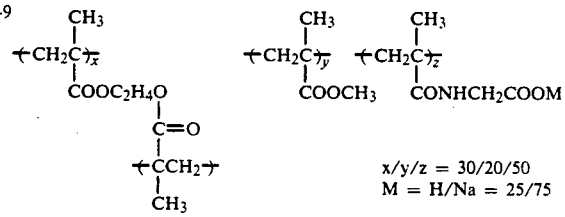

x/y/z = 30/20/50
M = H/Na = 25/75

P-10

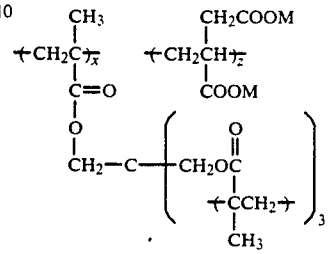

x/z = 40/60
M = H/Na = 10/90

SYNTHESIS EXAMPLES

Synthesis Example 1

Synthesis of the Exemplified Compound P-1

1.5 g of 72% methanol solution of sodium dodecylbenzenesulfonate, and 1300 ml of distilled water were added to a three neck flask equipped with a stirrer, a reflux condenser, a dropping funnel, and a thermometer, and the solution was heated to a temperature of 95° to 97° C. under a nitrogen atmosphere while stirring. A mixed solution of 120 g of acrylic acid (1.67 mole) and 80 g of ethylene glycol dimethacrylate (0.40 mole) and an aqueous solution prepared by dissolving 14.0 g of potassium persulfate in 400 ml of distilled water were simultaneously added dropwise over a period of 150 minutes for emulsion polymerization. After completion of the dropwise addition, the polymerization was further continued at the temperature of 95° to 97° C. for 90 minutes. After cooling to about 80° C., a solution prepared by dissolving 53.3 g of sodium hydroxide (1.33 mole) in 200 ml of distilled water was added for neutralization. After cooling to room temperature, the flocculates were filtered off, whereby 2170 g of the water dispersion (solid matter content: 11.3% by weight) of the crosslinked polymer P-1 was obtained. The viscosity was 7 cp (25° C.), and the pH was 6.3.

The other exemplified polymers were synthesized as well in the same manner as in the synthesis example 1.

The polymer represented by Formula (II) may be polymerized by the well known radical polymerization method (for example, as detailed in "An Experimental Method of Polymer Synthesis", written by Takayuki Ohtsu and Masaharu Kinoshita, pp. 124 to 154, published by Kagaku Dojin in 1972). In particular, a solution polymerization method is preferably used.

Where the solution polymerization method is used, the polymerization reaction may be carried out after each monomer is dissolved in a suitable solvent (for example, water or a mixed solvent of water and an organic solvent miscible with water (for example, methanol, ethanol, acetone and N,N-dimethylformamide)), or the polymerization reaction may be carried out while dropwise adding each monomer to the solution, wherein a suitable auxiliary solvent (the same as above) may be used in the dropwise addition.

The above solution polymerization is carried out with a conventional radical initiator (for example, an azo type initiator such as a 2,2'-azobis(2-amidinopropane) dihydrochloric acid salt and a peroxide initiator such as potassium persulfate) generally at a temperature of 30° to about 100° C., preferably 60° to about 95° C.

Examples of the polymer of the present invention represented by Formula (II) and the synthesis thereof are shown below, but the present invention is not limited thereto.

The copolymerization ratio described in the polymerization examples is shown in terms of a percentage by weight. The ratio of M is shown in terms of a molar ratio.

Q-1~Q-7

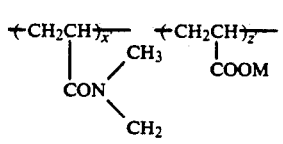

| | x'/z' | M |
|---|---|---|
| Q-1 | 5/95 | H/Na = 25/75 |
| Q-2 | 10/90 | " |
| Q-3 | 20/80 | " |
| Q-4 | 40/60 | " |
| Q-5 | 50/50 | " |
| Q-6 | 70/30 | " |
| Q-7 | 90/10 | " |

Q-8

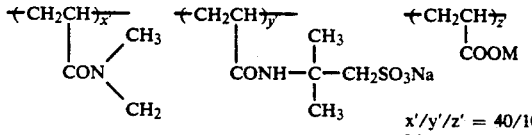

x'/y'/z' = 40/10/50
M = H/Na = 25/75

Q-9

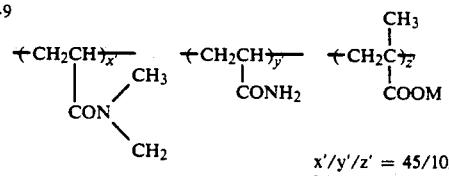

x'/y'/z' = 45/10/45
M = H/K = 10/90

Q-10

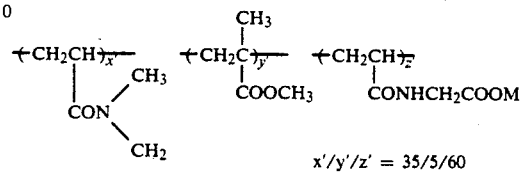

x'/y'/z' = 35/5/60
M = H/Na = 5/95

Q-11,12

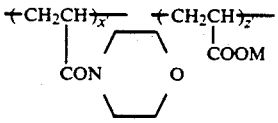

| | x'/z' | M |
|---|---|---|
| Q-11 | 20/80 | H/Na = 25/75 |
| Q-12 | 40/60 | " |

Q-13

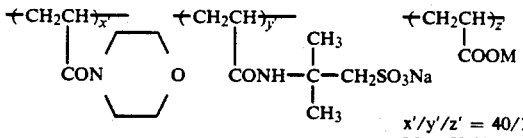

x'/y'/z' = 40/10/50
M = H/Na = 25/75

Q-14

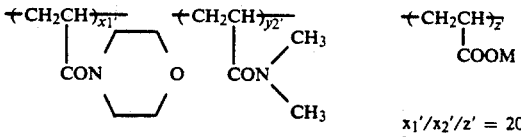

$x_1'/x_2'/z'$ = 20/20/60
M = H/K = 5/95

Q-15

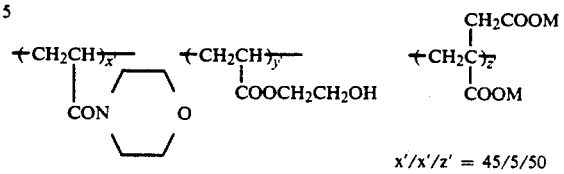

x'/x'/z' = 45/5/50
M = H/Na = 50/50

-continued

Q-16,17

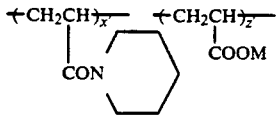

| | x'/z' | M |
|---|---|---|
| Q-16 | 20/80 | H/Na = 25/75 |
| Q-17 | 40/60 | " |

Q-18

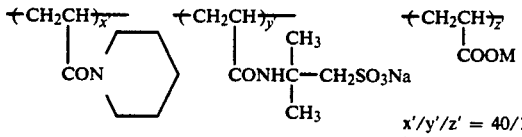

x'/y'/z' = 40/10/50
M = H/Na = 25/75

Q-19

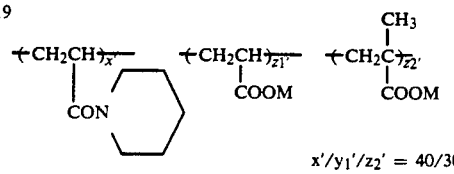

x'/y1'/z2' = 40/30/30
M = H/Na = 20/80

Q-20

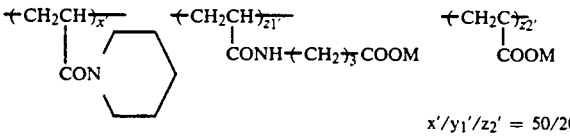

x'/y1'/z2' = 50/20/30
M = H/K = 5/95

Synthesis Example 2

Synthesis of the Exemplified Compound Q-4

1.74 liter of distilled water was added to a 3 liter three neck flask equipped with a stirrer, a thermometer, and a reflux condenser, and the solution was heated to 95° C. under a nitrogen atmosphere while stirring.

A solution prepared by dissolving 0.835 g of potassium persulfate in 50 ml of distilled water was added, and then a mixed solution of 1.67 g of potassium persulfate and 100 ml of distilled water and a mixed solution of 120 g of acrylic acid (1.67 mole) and 80 g of dimethyl acrylamide (0.81 mole) were added dropwise at a constant speed with a Robo Pump 3K-45A manufactured by Heidon Co., Ltd. over the period of one hour.

A solution prepared by dissolving 1.67 g of potassium persulfate in 50 ml of distilled water was added 30 minutes after the completion of the dropwise addition, and the stirring was continued for 3 hours at 95° C.

After cooling to room temperature, a solution prepared by dissolving 50.5 g of sodium hydroxide (1.26 mole) in 200 ml of distilled water was added and stirred at room temperature for 30 minutes, followed by filtering, whereby 2.36 kg of the solution of the compound Q-4 was obtained.

The polymer solution thus obtained had a solid matter content of 9.99% by weight, a solution viscosity of 23 cp, at 25° C. and pH of 6.3. The other water soluble polymers were synthesized in the same manner.

The ratio of the polymers represented by Formula (I) and Formula (II) which is used is preferably 60 to 99% by weight, particularly preferably 75 to 95% by weight, for the polymer of Formula (I), based on the sum thereof.

The total amount of the polymers represented by Formula (I) and Formula (II) which is used is preferably 0.1 to 20 g, particularly preferably 1 to 5 g, per $m^2$ of a photographic light-sensitive material. The amount of the polymers represented by Formula (I) and Formula (II) which is contained in an antistatic layer is preferably 10 to 90% by weight, particularly preferably 30 to 60% by weight, based on the total weight of the antistatic layer.

The amount of gelatin contained the antistatic layer is preferably 10 to 90% by weight, particularly preferably 40 to 70% by weight, based on the total weight of the antistatic layer.

The addition amount of a hardener is preferably $1.0\times10^{-5}$ to $1.0\times10^{-3}$ mole, particularly preferably $5.0\times10^{-5}$ to $3.0\times10^{-4}$ mole, per g of gelatin.

The present invention will be explained in detail with reference to the examples below. However, it is noted that the examples are not to be construed as limiting the present invention in any way. Unless otherwise noted, all parts, percents, ratios, and the like are by weight.

EXAMPLE 1

A multilayered silver halide color light-sensitive material was prepared comprising a back layer provided on one side of a cellulose triacetate film support and a light-sensitive layer provided on the other side of the support.

Composition Of The Back Layer

The numerals corresponding to the respective components represent the coated amounts expressed in terms of $g/m^2$.

| | |
|---|---|
| First layer: | |
| Binder: gelatin | 0.45 |
| Coating agent: sodium p-dodecylbenzenesulfonate | $1.6 \times 10^{-3}$ |
| Second layer: | |
| Binder: gelatin | 3.72 |
| Coating agent: sodium p-dodecylbenzenesulfonate | 0.011 |
| Antistatic agent: shown in Table 1 | 2.96 |
| Thickener: poly-sodium styrenesulfonate | 0.028 |
| Third layer: | |
| Binder: gelatin | 0.96 |
| Matting agent: polymethyl methacrylate (average particle size: 2.5μ) | 0.094 |
| Coating agent: sodium dioctylsulfosuccinate | 0.075 |
| Fluorinated surface active agent | $6.4 \times 10^{-3}$ |
| $C_8F_{17}SO_2N(C_3H_7)CH_2COOK$ | |
| Hardener: bis(vinylsulfonylmethyl) ether | 0.20 |

The respective layers having the following compositions were coated on the reverse side of the sample thus provided with the back layer.

Compositions Of The Light-sensitive Layer

The numerals corresponding to the respective components show the coated amounts expressed in terms of $g/m^2$, and those corresponding to the silver halides show the coated amounts converted to silver, except that the coated amounts of the sensitizing dyes are expressed in terms of mole per mole of silver halide contained in the same layer.

| Sample 101 | |
|---|---|
| First layer (an anti-halation layer) | |
| Black colloidal silver | silver 0.18 |
| Gelatin | 1.40 |
| Second layer (an intermediate layer) | |
| 2,5-Di-t-pentadecyl hydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| HBS-1 | 0.10 |
| HBS-2 | 0.020 |
| Gelatin | 1.04 |
| Third layer (the first red-sensitive layer) | |
| Emulsion A | silver 0.25 |
| Emulsion B | silver 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.17 |
| U-1 | 0.070 |
| U-2 | 0.050 |
| U-3 | 0.070 |
| HBS-1 | 0.060 |
| Gelatin | 0.87 |
| Fourth layer (the second red-sensitive layer) | |
| Emulsion G | silver 1.00 |
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.20 |
| EX-3 | 0.050 |
| EX-10 | 0.015 |
| EX-14 | 0.20 |

-continued

| Sample 101 | |
|---|---|
| EX-15 | 0.050 |
| U-1 | 0.070 |
| U-2 | 0.050 |
| U-3 | 0.070 |
| Gelatin | 1.30 |
| Fifth layer (the third red-sensitive layer) | |
| Emulsion D | silver 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| HBS-1 | 0.22 |
| HBS-2 | 0.10 |
| Gelatin | 1.63 |
| Sixth layer (an intermediate layer) | |
| EX-5 | 0.040 |
| HBS-1 | 0.20 |
| Gelatin | 0.80 |
| Seventh layer (the first green-sensitive layer) | |
| Emulsion A | silver 0.15 |
| Emulsion B | silver 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| EX-8 | 0.025 |
| HBS-1 | 0.10 |
| HBS-3 | 0.010 |
| Gelatin | 0.63 |
| Eighth layer (the second green-sensitive layer) | |
| Emulsion C | silver 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| EX-8 | 0.018 |
| HBS-1 | 0.16 |
| HBS-3 | $8.0 \times 10^{-3}$ |
| Gelatin | 0.50 |
| Ninth layer (the third green-sensitive layer) | |
| Emulsion E | silver 1.20 |
| Sensitizing dye IV | $3.5 \times 10^{-5}$ |
| Sensitizing dye V | $8.0 \times 10^{-5}$ |
| Sensitizing dye VI | $3.0 \times 10^{-4}$ |
| EX-1 | 0.013 |
| EX-11 | 0.065 |
| EX-13 | 0.019 |
| HBS-1 | 0.25 |
| HBS-2 | 0.10 |
| Gelatin | 1.54 |
| Tenth layer (a yellow filter layer) | |
| Yellow colloidal silver | silver 0.050 |
| EX-5 | 0.080 |
| HBS-1 | 0.030 |
| Gelatin | 0.95 |
| Eleventh layer (the first blue-sensitive layer) | |
| Emulsion A | silver 0.080 |
| Emulsion B | silver 0.070 |
| Emulsion F | silver 0.070 |
| Sensitizing dye VII | $3.5 \times 10^{-4}$ |
| EX-8 | 0.042 |
| EX-9 | 0.72 |
| HBS-1 | 0.28 |
| Gelatin | 1.10 |
| Twelfth layer (the second blue-sensitive layer) | |
| Emulsion G | silver 0.45 |
| Sensitizing dye VII | $2.1 \times 10^{-4}$ |
| EX-9 | 0.15 |
| EX-10 | $7.0 \times 10^{-3}$ |
| HBS-1 | 0.050 |

-continued

| Sample 101 | |
|---|---|
| Gelatin | 0.78 |
| Thirteenth layer (the third blue-sensitive layer) | |
| Emulsion H | silver 0.77 |
| Sensitizing dye VII | $2.2 \times 10^{-4}$ |
| EX-9 | 0.20 |
| HBS-1 | 0.070 |
| Gelatin | 0.69 |
| Fourteenth layer (the first protective layer) | |
| Emulsion I | silver 0.20 |
| U-4 | 0.11 |
| U-5 | 0.17 |
| HBS-1 | $5.0 \times 10^{-2}$ |
| Gelatin | 1.00 |

-continued

| Sample 101 | |
|---|---|
| Fifteenth layer (the second protective layer) | |
| H-1 | 0.40 |
| B-1 (dispersion of average diameter: 1.7 μm) | $5.0 \times 10^{-2}$ |
| B-2 (dispersion of average diameter: 1.7 μm) | 0.10 |
| B-3 | 0.10 |
| S-1 | 0.20 |
| Gelatin | 1.20 |

Further, W-1, W-2, W-3, B-4, B-5, F-1, F-2, F-3, F-4, F-5, F-6, F-7, F-8, F-9, F-10, F-11, F-12, F-13, an iron salt, a lead salt, a gold salt, a platinum salt, an iridium salt, and a rhodium salt was added to all layers to improve the preservativity, processing, antipressure, antimold, fungicidal, antistatic, and coating properties.

TABLE 1

| Emulsion | Average AgI Content (%) | Average Grain Size (μm) | Fluctuation Coefficient (%) | Diameter/ Thickness Ratio | Silver Amount Ratio (AgI Content %) |
|---|---|---|---|---|---|
| A | 4.0 | 0.45 | 27 | 1 | Core/Shell = ⅓ (13/1), double structure grains |
| B | 8.9 | 0.70 | 14 | 1 | Core/Shell = 3/7 (25/2), double structure grains |
| C | 10 | 0.75 | 30 | 2 | Core/Shell = ½ (24/3), double structure grains |
| D | 16 | 1.05 | 35 | 2 | Core/Shell = 4/6 (40/0), double structure grains |
| E | 10 | 1.05 | 35 | 3 | Core/Shell = ½ (24/3), double structure grains |
| F | 4.0 | 0.25 | 28 | 1 | Core/Shell = ⅓ (13/1), double structure grains |
| G | 14.0 | 0.75 | 25 | 2 | Core/Shell = ½ (42/0), double structure grains |
| H | 14.5 | 1.30 | 25 | 3 | Core/Shell = 37/63 (34/3), double structure grains |
| I | 1 | 0.07 | 15 | 1 | Homogeneous grains |

EX-1

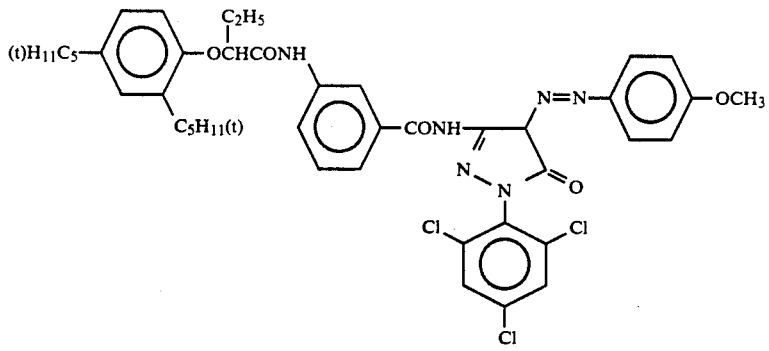

EX-2

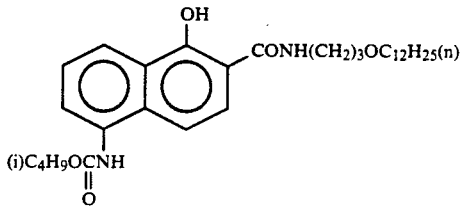

-continued
EX-3
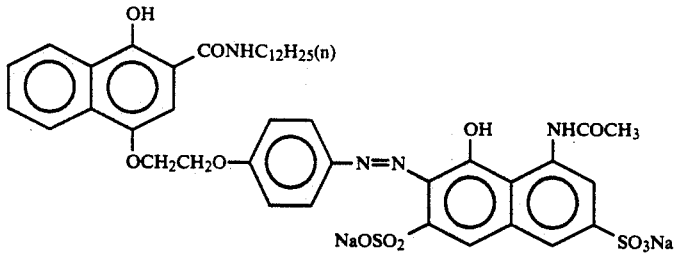
EX-4
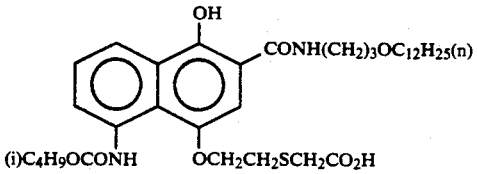
EX-5
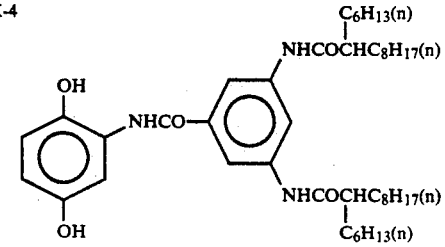
EX-6
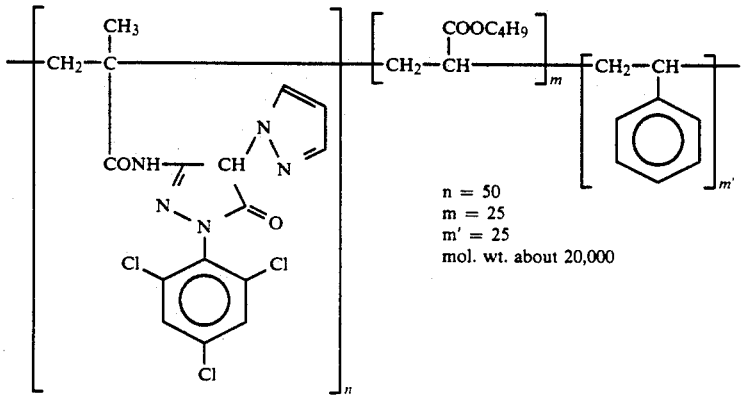
EX-7
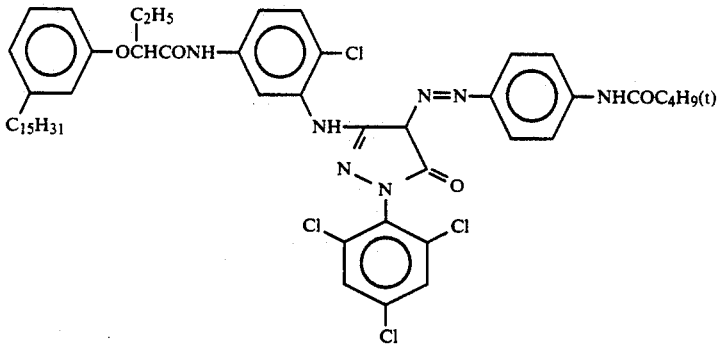
EX-8
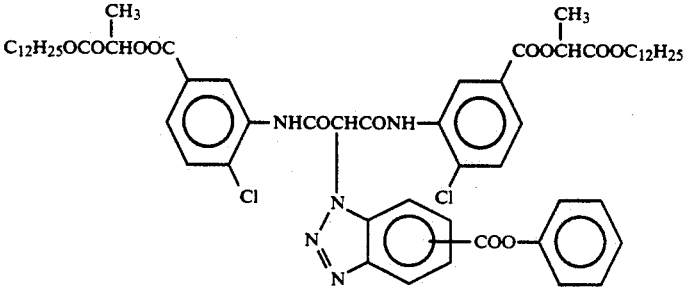

-continued
EX-9
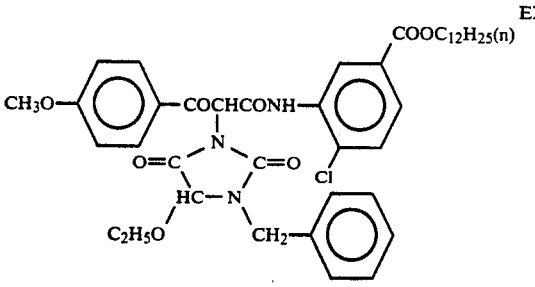
EX-10
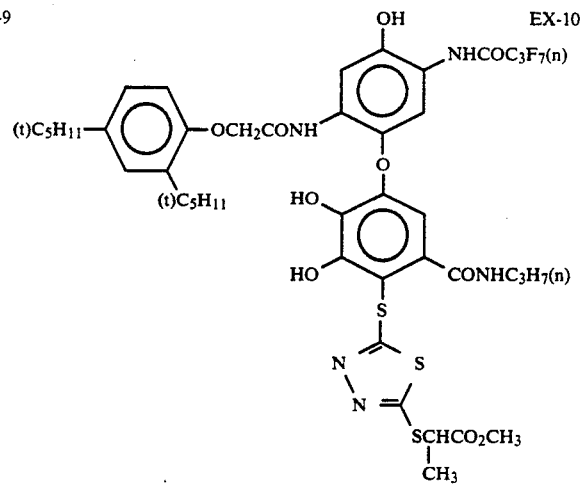
EX-11
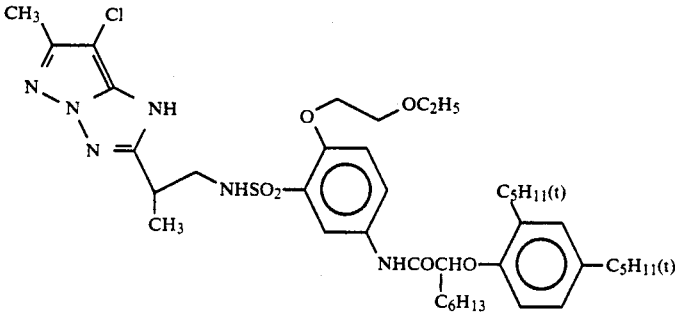
EX-12
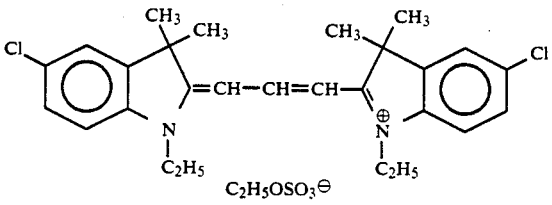
EX-13
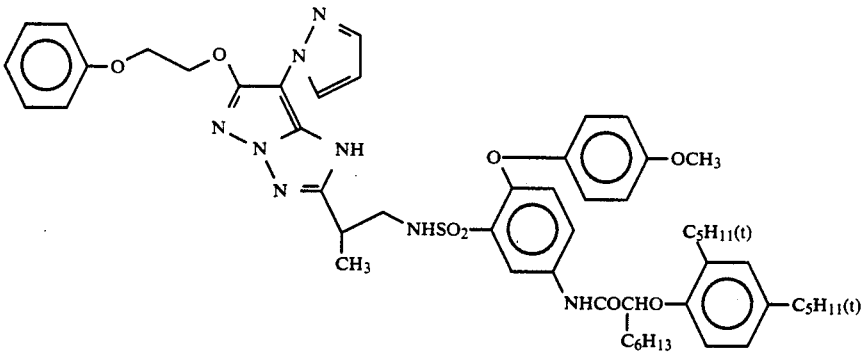
EX-14
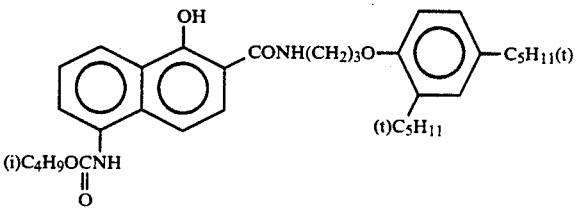

-continued
EX-15
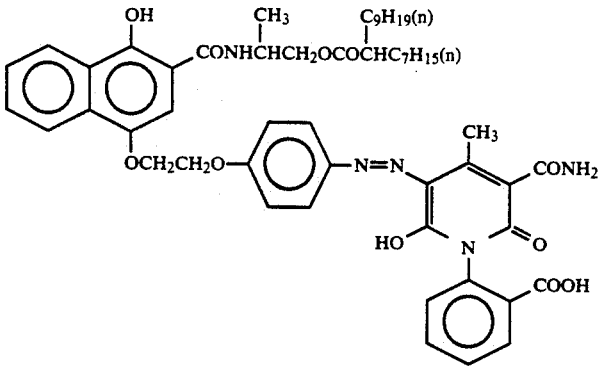
U-1
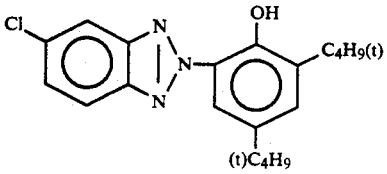
U-2
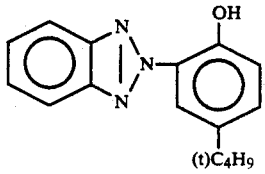
U-3
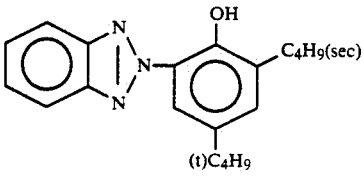
U-4
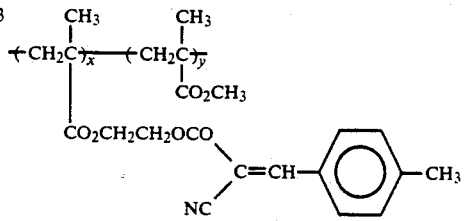
x:y = 70:30 (wt %)
U-5
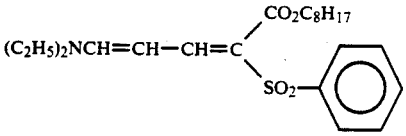
Tricresyl phosphate
HBS-1
Di-n-butyl phthalate
HBS-2
HBS-3
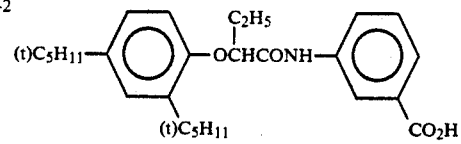
Sensitizing Dye I
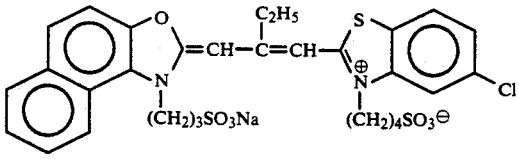
Sensitizing Dye II
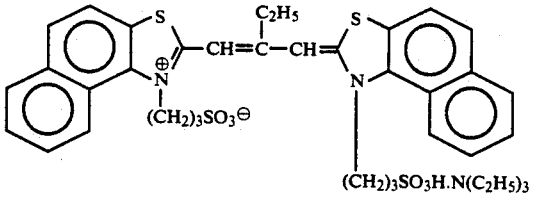
Sensitizing Dye III
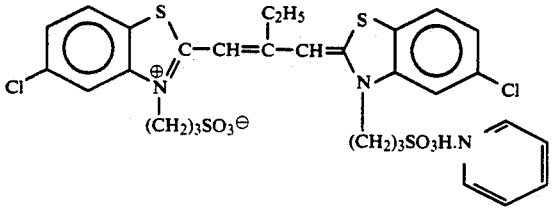
Sensitizing Dye IV
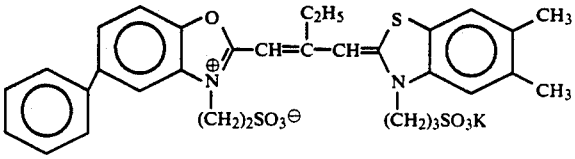

-continued
Sensitizing Dye V
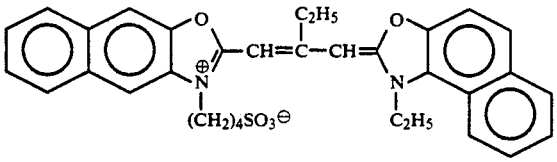
Sensitizing Dye VI
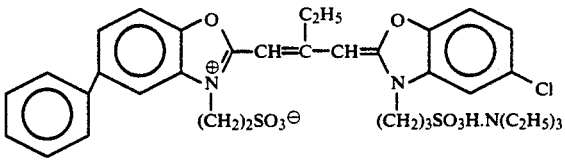
Sensitizing Dye VII
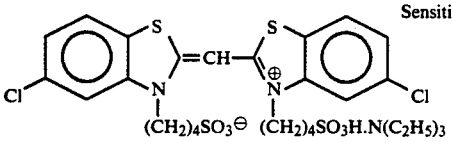
S-1
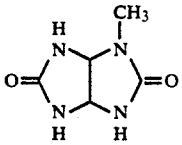
H-1
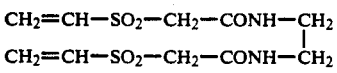
B-1
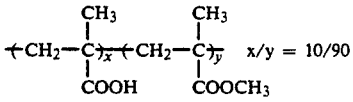
B-2
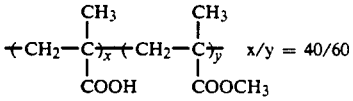
B-3
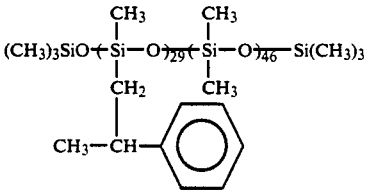
B-4
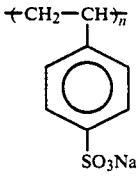
B-5
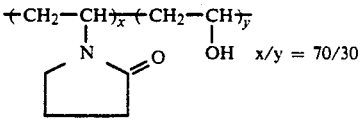
W-1
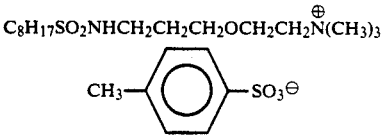
W-2
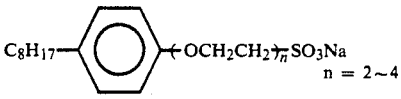
W-3
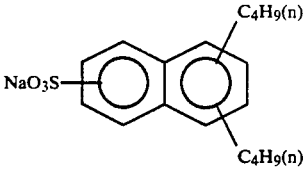
F-1
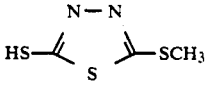
F-2
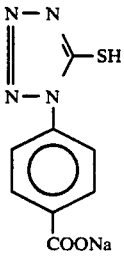
F-3
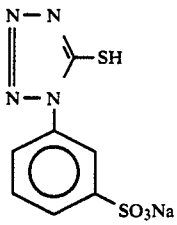
F-4
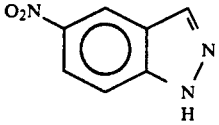
F-5
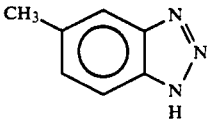

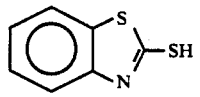

-continued

F-6

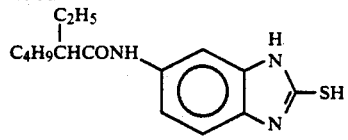

F-7

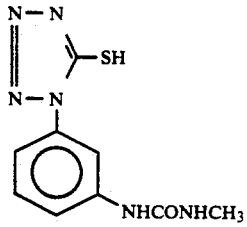

F-8

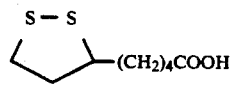

F-9

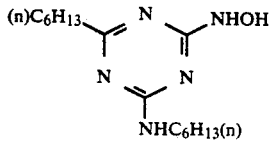

F-10

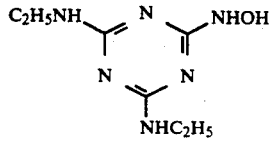

F-11

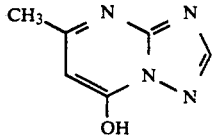

F-12

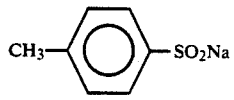

F-13

The following Samples 1 to 30 were thus prepared by coating the layers.

The antistatic agent contained in the second layer provided on the back side was replaced with the same weight of gelatin to thereby prepare Sample 1. The antistatic agents shown in Tables 2 to 4 were used to thereby prepare Samples 2 to 30, wherein the exemplified Polymers 1 to 3 are the compounds included in Formula (II) and the exemplified Polymers 4 to 7 are the compounds included in Formula (I). The coated amount of the hardener was reduced to ½ only in Samples 15 to 18 to carry out the coating.

Evaluation Of The Antistatic Property

The antistatic ability was determined by surface resistivity and the measurement of the generation of static marking.

(1) The surface resistivity was measured by sandwiching a test piece of the sample with the back side of the film up between electrodes made of brass, with the electrode interval being 0.14 cm and the length being 10 cm (stainless steel was used for the part contacting the test piece), and then measuring a one minute value with an insulation meter Type TR 8651, manufactured by Takeda Riken Co., Ltd.

(2) The static mark generation test was carried out by pressing an unexposed light-sensitive material placed on a rubber sheet with the emulsion layer side up with a rubber roller and then developing it to inspect the generation of the static mark. Humidity conditioning was carried out at the conditions of 25° C. and 25% RH for both the surface resistivity and static mark measuring tests, wherein the humidity conditioning was carried out for one day at the above conditions. The static marking was evaluated with the following three grades:

A: no generation of static marking,

B: a little generation of static marking, and

C: overall generation of static marking.

Measuring Method Of The Swelling Rate Of A Layer

A test piece was dipped in developing solution at 38° C. (the developing solution used in Example 1) for two minutes, and then the thickness of the swollen layer was measured to calculate the swelling rate of the layer from the following equation:

Swelling rate = thickness of the swollen layer/thickness of the layer before swelling.

wherein the thickness of the swollen layer was measured with the method described in *J. Photographic Science*, Vol. 20, pp. 205–210 (1972).

Transportation Test With A Roller Transporting Type Automatic Developing Machine A test piece was processed to a 120 size, and the transportation test was carried out with a roller transporting type automatic the developing machine having no film pressing rollers in the drying zone (QSS-B9L, manufactured by Noritsu Co., Ltd.). The evaluation was made with the following three grades according to the degree of flaws in the film:

A: no scratchs,

B: scratchs generated at the end of a film, and

C heavy folding on the film.

Evaluation Method For An Elution Trace Of An Antistatic Agent

A test piece was processed by the processing method (A) described below, and then the surface thereof was inspected. The degree of the elution trace was classified according to the following three grades:

A: no generation of the elution trace,

B: a little generation of the elution trace observed, and

C: overall generation of the elution trace.

| Step | Processing method (A) Time | Temperature |
|---|---|---|
| Color developing | 3 minutes & 15 seconds | 38° C. |
| Bleaching | 1 minute | 38° C. |
| Bleach-fixing | 3 minutes & 15 seconds | 38° C. |
| Rinsing (1) | 40 seconds | 35° C. |
| Rinsing (2) | 1 minute | 35° C. |
| Stabilizing | 40 seconds | 38° C. |
| Drying | 1 minute & 15 seconds | 55° C. |

| | |
|---|---|
| Color developing solution | |
| Diethylenetriaminepentacetic acid | 1.0 g |
| 1-Hydroxyethylidene-1,1-diphosphonic acid | 3.0 g |
| Sodium sulfite | 4.0 g |
| Potassium carbonate | 30.0 g |
| Potassium bromide | 1.4 g |
| Potassium iodide | 1.5 ml |
| Hydroxylamine sulfate | 2.4 g |
| 4-(N-ethyl-N-β-hydroxyethylamino)-2-methylaniline sulfate | 4.5 g |
| Water was added to make the total quantity | 1.0 l |
| pH | 10.05 |
| Bleaching solution | |
| Ferric sodium ethylenediamine-tetracetate dihydrate | 120.0 g |
| Disodium ethylenediaminetetracetate | 10.0 g |
| Ammonium bromide | 100.0 g |
| Ammonium nitrate | 10.0 g |
| Bleaching accelerator | 0.005 mole |

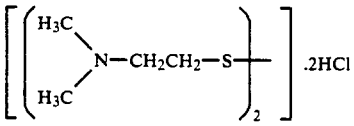

| | |
|---|---|
| Ammonia water (27%) | 15 ml |
| Water was added to make the total quantity | 1.0 l |
| pH | 6.3 |
| Bleaching-fixing solution | |
| Ferric ammonium ethylenediamine-tetracetate dihydrate | 50.0 g |
| Disodium ethylenediaminetetracetate | 5.0 g |
| Sodium sulfite | 12.0 g |

-continued

| | |
|---|---|
| Ammonium thiosulfate aqueous solution (70%) | 240.0 ml |
| Ammonia water (27%) | 6.0 ml |
| Water was added to make the total quantity | 1.0 l |
| pH | 7.2 |

Rinsing Water

City water was introduced into a mixed bed type column filled with an H-type strong acidic cation exchange resin (Amberlite IR-120B) and an OH-type strong base anion exchange resin (Amberlite IRA-400), each manufactured by Rohm & Haas Co., Ltd. to reduce the ion concentrations of calcium and magnesium to 3 mg/liter or less, and subsequently sodium dichloroisocyanurate in an amount of 20 mg/liter and sodium sulfate in an amount of 150 mg/liter were added. The pH range of this solution was 6.5 to 7.5.

| Stabilizing solution | |
|---|---|
| Formalin (37%) | 2.0 ml |
| Polyoxyethylene-p-monononylphenyl ether (average polymerization degree: 10) | 0.3 g |
| Disodium ethylenediaminetetracetate | 0.05 g |
| Water was added to make the total quantity | 1.0 l |
| pH | 5.0 to 8.0 |

Layer Strength

A test piece was dipped in a developing solution at 38° C. for 5 minutes, and then it was scratched with a scratch strength meter in which a load of 0 to 100 g was continuously exerted with a sapphire needle having a diameter of 0.5 mm to evaluate the layer strength according to the degree of the load at which the scratches first appeared. A load of 40 g or more at which the scratches first appeared as measured by the above method presents no problem in the market. A load of 20 g or less presents a problem, since the light-sensitive material will be scratched when it is passed through a roller transporting type automatic developing machine.

The results thus obtained are shown in Tables 2 to 4.

TABLE 2

| Sample No. | Antistatic agent | Coated amount | Antistatic property: Surface resistivity | Antistatic property: Static marking | Swelling rate*1 | Transportation test | Elution trace | Layer strength (g) |
|---|---|---|---|---|---|---|---|---|
| 1 (Comp.) | — | 0 | $1.1 \times 10^{14}$ | C | 2.0 | C | A | 80 |
| 2 (Comp.) | Polymer 1 (Q-4) | 2.96 | $1.9 \times 10^{11}$ | A | 20 or more | *2 | *2 | ~1 |
| 3 (Comp.) | Polymer 2 (Q-12) | 2.96 | $2.5 \times 10^{11}$ | A | ~20 | *2 | *2 | ~1 |
| 4 (Comp.) | Polymer 3 (Q-18) | 2.96 | $2.1 \times 10^{11}$ | A | ~15 | *2 | *2 | ~1 |
| 5 (Inv.) | Polymer 1 + Polymer 4 (P-2) | 0.30 + 2.66 | $3.3 \times 10^{11}$ | A | 3.9 | A | A | 48 |
| 6 (Inv.) | Polymer 2 + Polymer 4 | 0.44 + 2.52 | $3.8 \times 10^{11}$ | A | 3.9 | A | A | 45 |
| 7 (Inv.) | Polymer 3 + Polymer 4 | 0.74 + 2.22 | $3.5 \times 10^{11}$ | A | 3.9 | A | A | 53 |
| 8 (Inv.) | Polymer 1 + Polymer 5 (P-4) | 0.32 + 2.64 | $3.4 \times 10^{11}$ | A | 3.8 | A | A | 50 |
| 9 (Inv.) | Polymer 1 + Polymer 6 (P-7) | 0.40 + 2.56 | $3.5 \times 10^{11}$ | A | 3.9 | A | A | 48 |

Coated amount: $g/m^2$
Surface resistivity: Ω
*1 Swelling rate of the back layer.
*2 Cannot be measured because of the peeling off of the layer.

TABLE 3

| Sample No. | Antistatic agent | Coated amount | Antistatic property: Surface resistivity | Antistatic property: Static marking | Swelling rate*1 | Transportation test | Elution trace | Layer strength (g) |
|---|---|---|---|---|---|---|---|---|
| 10 (Inv.) | Polymer 1 + Polymer 7 (P-9) | 0.38 + 2.58 | $3.3 \times 10^{11}$ | A | 3.8 | A | A | 46 |
| 11 (Comp.) | Polymer 4 | 2.96 | $4.3 \times 10^{11}$ | A | 2.1 | C | A | 62 |
| 12 (Comp.) | Polymer 5 | 2.96 | $4.0 \times 10^{11}$ | A | 2.2 | C | A | 61 |
| 13 (Comp.) | Polymer 6 | 2.96 | $3.8 \times 10^{11}$ | A | 2.0 | C | A | 68 |
| 14 (Comp.) | Polymer 7 | 2.96 | $4.1 \times 10^{11}$ | A | 1.8 | C | A | 70 |
| 15 (Comp.) | Polymer 4 | 2.96 | $4.3 \times 10^{11}$ | A | 3.9 | A | A | 12 |
| 16 (Comp.) | Polymer 5 | 2.96 | $4.0 \times 10^{11}$ | A | 3.9 | A | A | 11 |
| 17 (Comp.) | Polymer 6 | 2.96 | $3.8 \times 10^{11}$ | A | 3.8 | A | A | 14 |
| 18 (Comp.) | Polymer 7 | 2.96 | $4.1 \times 10^{11}$ | A | 3.6 | A | A | 15 |
| 19 (Comp.) | Comp. Polymer A | 2.96 | $2.1 \times 10^{11}$ | A | 3.8 | A | C | 44 |

Coated amount: $g/m^2$
Surface resistivity: Ω
In Samples No. 15 to 18, the hardener amount was reduced by one half.
*1Swelling rate of the back layer.

TABLE 4

| Sample No. | Antistatic agent | Coated amount | Antistatic property: Surface resistivity | Antistatic property: Static marking | Swelling rate*1 | Transportation test | Elution trace | Layer strength (g) |
|---|---|---|---|---|---|---|---|---|
| 20 (Comp.) | Comp. Polymer B | 2.96 | $2.3 \times 10^{11}$ | A | 3.5 | A | C | 50 |
| 21 (Comp. | Comp. Polymer C | 2.96 | $1.8 \times 10^{11}$ | A | 3.6 | A | C | 35 |
| 22 (Comp.) | Comp. Polymer D | 2.96 | $1.9 \times 10^{11}$ | A | 3.8 | A | C | 32 |
| 23 (Comp.) | Comp. Polymer E | 2.96 | $2.7 \times 10^{11}$ | A | 3.3 | A | C | 45 |
| 24 (Comp.) | Comp. Polymer F | 2.96 | $2.4 \times 10^{11}$ | A | 3.1 | A | C | 41 |
| 25 (Comp.) | Comp. Polymer G | 2.96 | $2.6 \times 10^{11}$ | A | 3.5 | A | C | 42 |
| 26 (Comp.) | Comp. Polymer A + Polymer 4 | 0.74 + 2.22 | $3.6 \times 10^{11}$ | A | 2.5 | C | A | 57 |
| 27 (Comp.) | Comp. Polymer A + Polymer 4 | 1.78 + 1.18 | $3.4 \times 10^{11}$ | A | 3.5 | A | C | 40 |
| 28 (Comp.) | Comp. Polymer B + Polymer 4 | 0.74 + 2.22 | $3.6 \times 10^{11}$ | A | 2.5 | C | A | 48 |
| 29 (Comp.) | Comp. Polymer D + Polymer 4 | 0.74 + 2.22 | $3.0 \times 10^{11}$ | A | 2.6 | C | A | 53 |
| 30 (Comp.) | Comp. Polymer F + Polymer 4 | 0.74 + 2.22 | $3.1 \times 10^{11}$ | A | 2.3 | C | A | 58 |

Coated amount: $g/m^2$
Surface resistivity: Ω
*1 Swelling rate of the back layer.

As shown in Tables 3 and 4, where the anionic water soluble polymers were singly used as an antistatic agent (Sample Nos. 19 to 25), the addition of an amount which made the static making good caused no problem with respect to curling and provided an excellent transporting property with a processing machine because of the low swelling rate of the back layer, but it caused the notable problem on the elution trace and markedly damaged the appearance of the finished photos.

While they are highly analogous to those used for Sample Nos. 19 to 25 in terms of the structure, the water soluble polymers used for Samples No. 1 to 3 showed notable swelling and caused the peeling of a layer and the reduction in the layer strength.

Meanwhile, in Sample Nos. 11 to 14, in which the anionic crosslinked polymers were singly used, curling was generated because of the reduction in the layer strength, and the transportation property with a processing machine was deteriorated.

Further, the reduction in the amount of a hardener for solving this problem (Sample Nos. 15 to 18) resultsed in lowering the layer strength. Accordingly, the single use of the anionic crosslinked polymer of Formula (I) can not make the layer strength compatible with the transportation property with a processing machine.

The combined use of the compounds of Formula (I) and Formula (II) (Sample Nos. 5 to 10) overcame all of the problems of the above elution trace, layer strength and transportation property with a processing machine and provided an excellent antistatic ability as well.

Where anionic water soluble polymers not included in the scope of Formula (II) were used in combination with the crosslinked polymers of Formula (I), the scratches from transporting were insufficiently prevented because of the insufficient swelling rate of the back layer (Sample Nos. 26 and 28 to 30), or the elution trace became a problem because of the use of an excessive amount of the water soluble polymers (Sample No. 27).

Accordingly, the effects of the present invention show the specific swelling property. It is apparent that the use of the compound of Formula (II) in a small amount compared with the compound of Formula (I) is the specific combination by which the needed properties can be wholly satisfied.

The chemical structures of the comparative compounds used in Tables 2 to 4 are shown below:

Comparative Polymer A

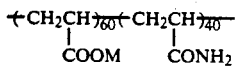

M: H/Na = 25/75

Comparative Polymer B

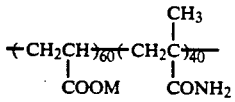

M: H/Na = 25/75

Comparative Polymer

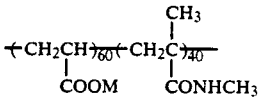

M: H/Na = 25/75

Comparative Polymer D

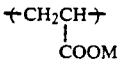

M: H/Na = 25/75

Comparative Polymer E

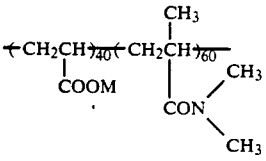

M: H/Na = 25/75

Comparative Polymer F

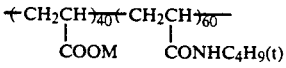

M: H/Na = 25/75

Comparative Polymer G

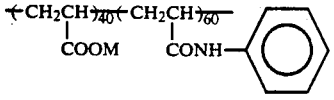

M: H/Na = 25/75

EXAMPLE 2

The back layer coated samples prepared in Example 1 were used to coat the respective layers having the following compositions on the opposite side to the back layer. The numerals show the addition amounts per $m^2$.

| | |
|---|---|
| First layer (an anti-halation layer) | |
| Black colloidal silver | 0.25 g |
| Gelatin | 1.9 g |
| UV absorber U-1 | 0.04 g |
| UV absorber U-2 | 0.1 g |
| UV absorber U-3 | 0.1 g |
| UV absorber U-4 | 0.1 g |
| UV absorber U-6 | 0.1 g |
| High boiling organic solvent Oil-1 | 0.1 g |
| Second layer (an intermediate layer) | |
| Gelatin | 0.40 g |
| Compound Cpd-D | 10 mg |
| High boiling organic solvent Oil-3 | 0.1 g |
| Dye D-4 | 0.4 mg |
| Third layer (an intermediate layer) | |
| Silver bromoiodide fine grain emulsion whose surface and inside were fogged (average grain size: 0.06 μm, flutuation coefficient: 18%, AgI content: 1 mole %) | silver amount 0.05 g |
| Gelatin | 0.4 g |
| Fourth layer (a low red-sensitive layer) | |
| Emulsion A | silver amount 0.2 g |
| Emulsion B | silver amount 0.3 g |
| Gelatin | 0.8 g |
| Coupler C-1 | 0.15 g |
| Coupler C-2 | 0.05 g |
| Coupler C-9 | 0.05 g |
| Compound Cpd-D | 10 mg |
| High boiling organic solvent Oil-2 | 0.1 g |
| Fifth layer (a medium red-sensitive layer) | |
| Emulsion B | silver amount 0.2 g |
| Emulsion C | silver amount 0.3 g |
| Gelatin | 0.8 g |
| Coupler C-1 | 0.2 g |
| Coupler C-2 | 0.05 g |
| Coupler C-3 | 0.2 g |
| High boiling organic solvent Oil-2 | 0.1 g |
| Sixth layer (a high red-sensitive layera) | |
| Emulsion D | silver amount 0.4 g |
| Gelatin | 1.1 g |
| Coupler C-1 | 0.3 g |
| Coupler C-3 | 0.7 g |
| Additive P-1 | 0.1 g |
| Seventh layer (an intermediate layer) | |
| Gelatin | 0.6 g |
| Additive M-1 | 0.3 g |
| Anti-color mixing agent Cpd-K | 2.6 mg |
| UV absorber U-1 | 0.1 g |
| UV absorber U-6 | 0.1 g |
| Dye D-1 | 0.02 g |
| Eighth layer (an intermediate layer) | |
| Silver bromoiodide fine grain emulsion whose surface and inside were fogged (average grain size: 0.06 μm, fluctuation coefficient: 16%, AgI content: 0.3 mole %) | silver amount 0.02 g |
| Gelatin | 1.0 g |
| Additive P-1 | 0.2 g |
| Anti-color mixing agent Cpd-J | 0.1 g |
| Anti-color mixing agent Cpd-A | 0.1 g |
| Ninth layer (a low green-sensitive layer) | |
| Emulsion E | silver amount 0.3 g |
| Emulsion F | silver amount 0.1 g |
| Emulsion G | silver amount 0.1 g |
| Gelatin | 0.5 g |
| Coupler C-7 | 0.05 g |
| Coupler C-8 | 0.20 g |
| Compound Cpd-B | 0.03 g |
| Compound Cpd-D | 10 mg |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-1 | 0.1 g |
| High boiling organic solvent Oil-2 | 0.1 g |
| Tenth layer (a medium green-sensitive layer) | |
| Emulsion G | silver amount 0.3 g |
| Emulsion H | silver amount 0.1 g |
| Gelatin | 0.6 g |

-continued

| | |
|---|---|
| Coupler C-7 | 0.2 g |
| Coupler C-8 | 0.1 g |
| Compound Cpd-B | 0.03 g |
| Compound Cpd-E | 0.02 g |
| Compound Cpd-F | 0.02 g |
| Compound Cpd-G | 0.05 g |
| Compound Cpd-H | 0.05 g |
| High boiling organic solvent Oil-2 | 0.01 g |
| Eleventh layer (a high green-sensitive layer) | |
| Emulsion I | silver amount 0.5 g |
| Gelatin | 1.0 g |
| Coupler C-4 | 0.3 g |
| Coupler C-8 | 0.1 g |
| Compound Cpd-B | 0.08 g |
| Compound Cpd-E | 0.02 g |
| Compound Cpd-F | 0.02 g |
| Compound Cpd-G | 0.02 g |
| Compound Cpd-H | 0.02 g |
| High boiling organic solvent Oil-1 | 0.02 g |
| High boiling organic solvent Oil-2 | 0.02 g |
| Twelfth layer (an intermediate layer) | |
| Gelatin | 0.6 g |
| Dye D-1 | 0.1 g |
| Dye D-2 | 0.05 g |
| Dye D-3 | 0.07 g |
| Thirteenth layer (a yellow filter layer) | |
| Yellow colloidal silver | silver amount 0.1 g |
| Gelatin | 1.1 g |
| Anti-color mixing agent Cpd-A | 0.01 g |
| High boiling organic solvent Oil-1 | 0.01 g |
| Fourteenth layer (an intermediate layer) | |
| Gelatin | 0.6 g |
| Fifteenth layer (a low blue-sensitive layer) | |
| Emulsion J | silver amount 0.4 g |
| Emulsion K | silver amount 0.1 g |
| Emulsion L | silver amount 0.1 g |
| Gelatin | 0.8 g |
| Coupler C-5 | 0.6 g |

-continued

| | |
|---|---|
| Sixteenth layer (a medium blue-sensitive layer) | |
| Emulsion L | silver amount 0.1 g |
| Emulsion M | silver amount 0.4 g |
| Gelatin | 0.9 g |
| Coupler C-5 | 0.3 g |
| Coupler C-6 | 0.3 g |
| Seventeenth layer (a high blue-sensitive layer) | |
| Emulsion N | silver amount 0.4 g |
| Gelatin | 1.2 g |
| Coupler C-6 | 0.7 g |
| Eighteenth layer (the first protective layer) | |
| Gelatin | 0.7 g |
| UV absorber U-1 | 0.04 g |
| UV absorber U-2 | 0.01 g |

-continued

| | |
|---|---|
| UV absorber U-3 | 0.03 g |
| UV absorber U-4 | 0.03 g |
| UV absorber U-5 | 0.05 g |
| UV absorber U-6 | 0.05 g |
| High boiling organic solvent Oil-1 | 0.02 g |
| Formalin scavenger | |
| Cpd-C | 0.2 g |
| Cpd-I | 0.4 g |
| Dye D-3 | 0.05 g |
| Nineteenth layer (the second protective layer) | |
| Colloidal silver | silver amount 0.1 mg |
| Silver bromoiodide fine grain emulsion (average grain size: 0.06 μm, AgI content: 1 mole %) | silver amount 0.1 g |
| Gelatin | 0.4 g |
| Twentieth layer (the third protective layer) | |
| Gelatin | 0.4 g |
| Polymethyl methacrylate (average grain size: 1.5 μm) | 0.1 g |
| Copolymer of methyl methacrylate and acrylic acid (4:6) (average grain size: 1.5 μm) | 0.1 g |
| Silicon oil | 0.03 g |
| Surface active agent W-1 | 3.0 mg |
| Surface active agent W-2 | 0.03 g |

In addition to the above components, the additives F-1 to F-8 were added to all of the emulsion layers. Further, in addition to the above components, a gelatin hardener H-1 and the surface active agents W-3 and W-4 for coating and emulsifying were added to each of the layers.

Further, phenol, 1,2-benzisothiazoline-3-one, 2-phenoxyethanol, and phenethyl alcohol were added as a fungicide and an anti-mold agent.

TABLE 5

The silver bromoiodide emulsions used for Sample Nos. 31 to 36 are shown below:

| Emulsion | Average grain size (μm) | Fluctuation coefficient (%) | AgI content (%) |
|---|---|---|---|
| A. Monodispersed tetradecahedral grains | 0.25 | 16 | 3.7 |
| B. Monodispersed cubic, internal latent image-type grains | 0.30 | 10 | 3.3 |
| C. Monodispersed tetradecahedral grains | 0.30 | 18 | 5.0 |
| D. Polydispersed twinned grains | 0.60 | 25 | 2.0 |
| E. Monodispersed cubic grains | 0.17 | 17 | 4.0 |
| F. Monodispersed cubic grains | 0.20 | 16 | 4.0 |
| G. Monodispersed cubic, internal latent image-type grains | 0.25 | 11 | 3.5 |
| H. Monodispersed cubic, internal latent image-type grains | 0.30 | 9 | 3.5 |
| I. Polydispersed tabular grains, average aspect ratio: 4.0 | 0.80 | 28 | 1.5 |
| J. Monodispersed tetradecahedral grains | 0.30 | 18 | 4.0 |
| K. Monodispersed tetradecahedral grains | 0.37 | 17 | 4.0 |
| L. Monodispersed cubic, internal latent image-type grains | 0.46 | 14 | 3.5 |
| M. Monodispersed cubic grains | 0.55 | 13 | 4.0 |
| N. Polydispersed tabular grains, average aspect ratio: 7.0 | 1.00 | 33 | 1.3 |

TABLE 6

Spectral sensitization of Emulsions A to N

| Emulsion | Sensitizing dye added | Added amount per mol of AgX | Timing to add sensitizing dye |
|---|---|---|---|
| A | S-1 | 0.025 g | IV |
| | S-2 | 0.25 g | IV |
| B | S-1 | 0.01 g | II |
| | S-2 | 0.25 g | II |
| C | S-1 | 0.02 g | IV |
| | S-2 | 0.25 g | IV |
| D | S-1 | 0.01 g | IV |
| | S-2 | 0.10 g | IV |
| | S-7 | 0.01 g | IV |
| E | S-3 | 0.5 g | IV |
| | S-4 | 0.1 g | IV |
| F | S-3 | 0.3 g | IV |
| | S-4 | 0.1 g | IV |

TABLE 6-continued

| Emulsion | Spectral sensitization of Emulsions A to N: Sensitizing dye added | Added amount per mol of AgX | Timing to add sensitizing dye |
|---|---|---|---|
| G | s-3 | 0.25 g | II |
| | S-4 | 0.08 g | II |
| H | S-3 | 0.2 g | I |
| | S-4 | 0.06 g | I |
| I | S-3 | 0.3 g | III |
| | S-4 | 0.07 g | III |
| | S-8 | 0.1 g | III |
| J | S-6 | 0.2 g | I |
| | S-5 | 0.05 g | I |
| K | S-6 | 0.2 g | I |
| | S-5 | 0.05 g | I |

TABLE 6-continued

| Emulsion | Spectral sensitization of Emulsions A to N: Sensitizing dye added | Added amount per mol of AgX | Timing to add sensitizing dye |
|---|---|---|---|
| L | S-6 | 0.22 g | II |
| | S-5 | 0.06 g | II |
| M | S-6 | 0.15 g | IV |
| | S-5 | 0.04 g | IV |
| N | S-6 | 0.22 g | II |
| | S-5 | 0.06 g | II |

I: during grain formation
II: immediately after finishing the grain formation
III: immediately before starting chemical sensitization
IV: immediately after finishing chemical sensitization

C-1

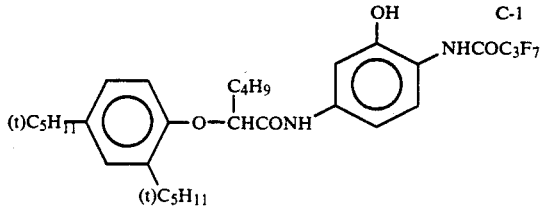

C-2

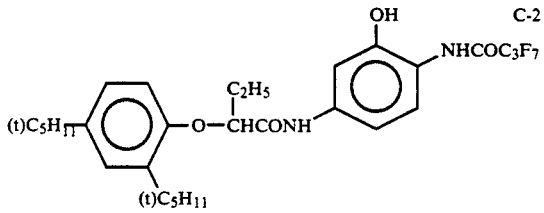

C-3

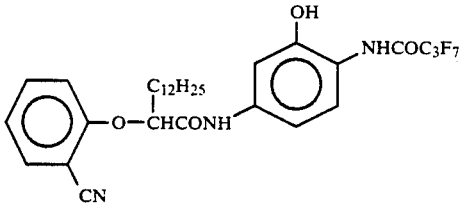

C-4

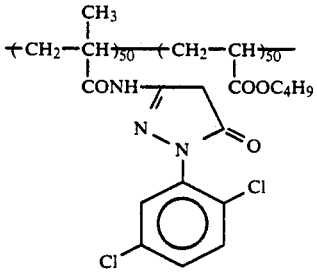

numerals are % by weight average molecular weight: about 25,000

C-5

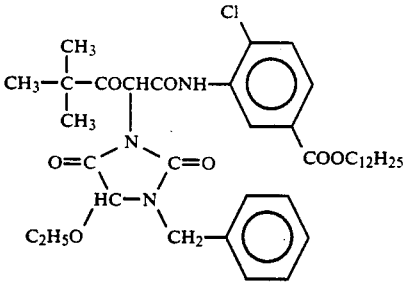

C-6

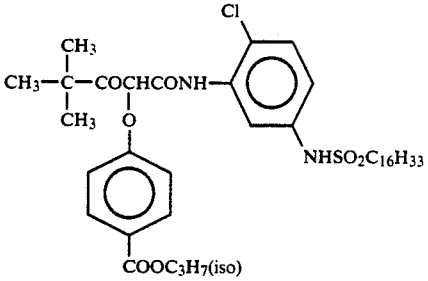

C-7

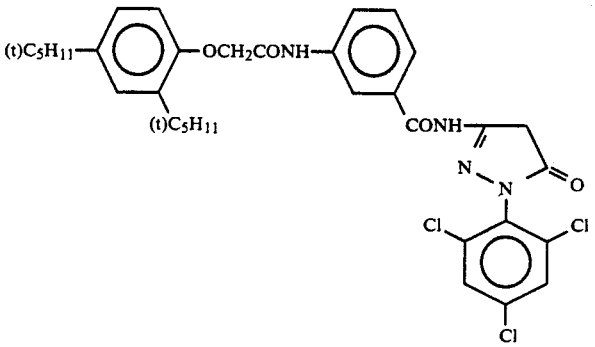

-continued
C-8
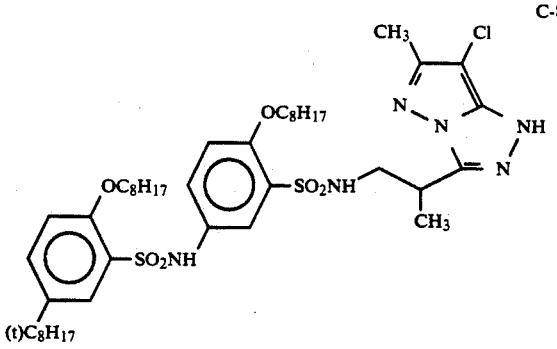
C-9
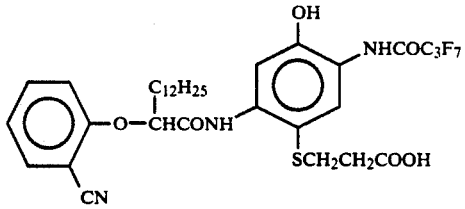
Dibutyl phthalate Oil-1
Trioctyl phosphate Oil-2
Oil-3
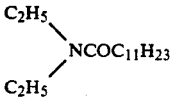
Cpd-A
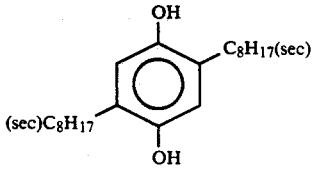
Cpd-B
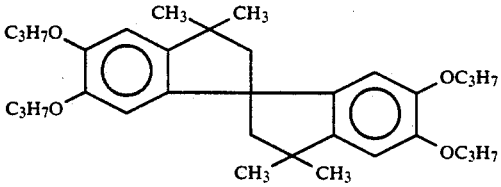
Cpd-C
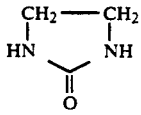
Cpd-D
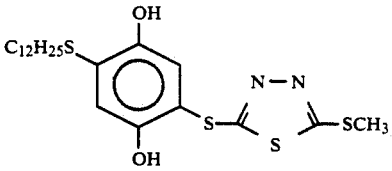
Cpd-E
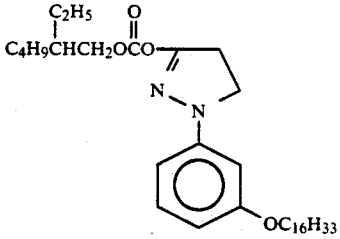
Cpd-F
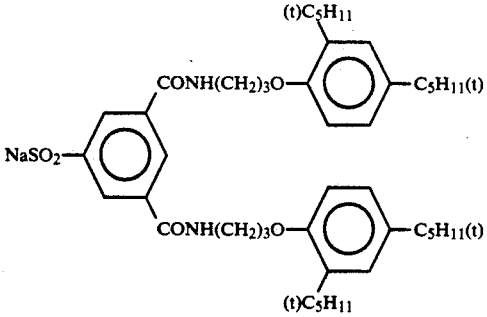
Cpd-G
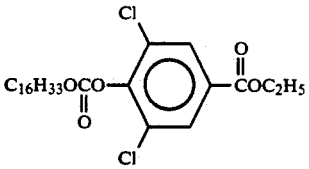
Cpd-H
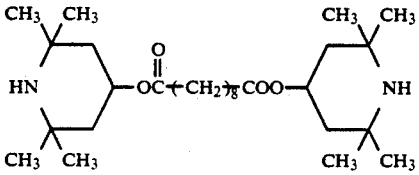
Cpd-I
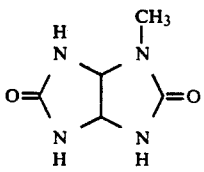

-continued
Cpd-J
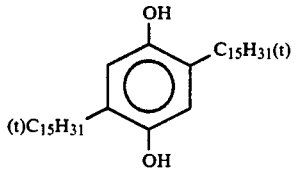
Cpd-K
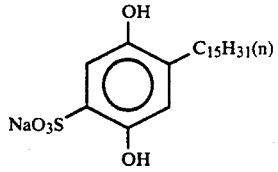
U-1
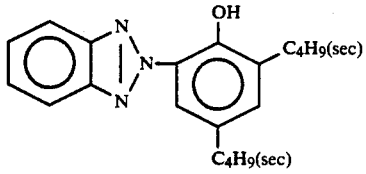
U-2
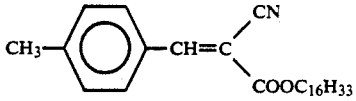
U-3
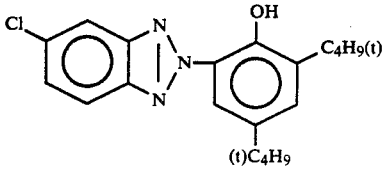
U-4
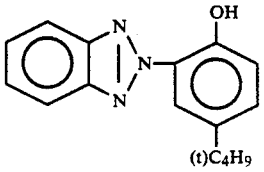
U-5
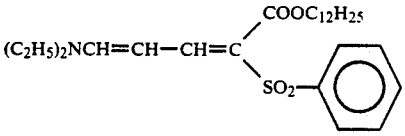
U-6
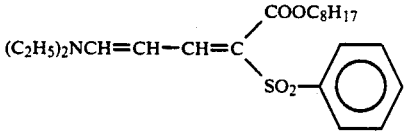
S-1
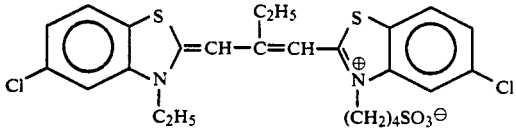
S-2
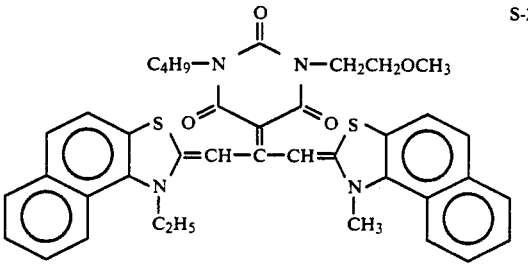
S-3
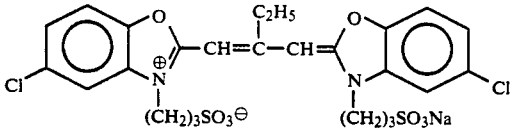
S-4
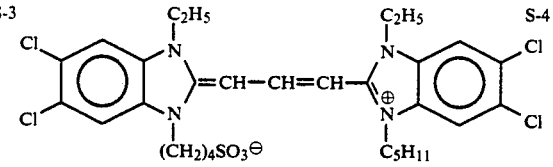
S-5
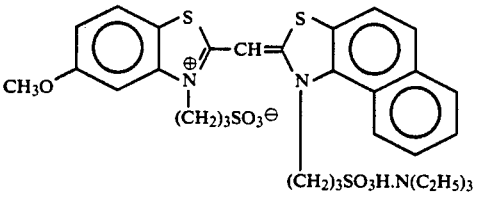
S-6
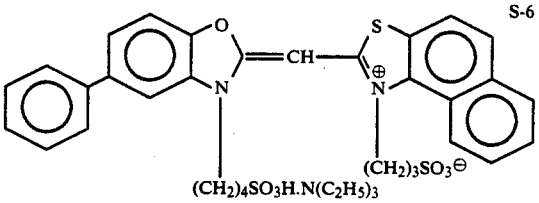
S-7
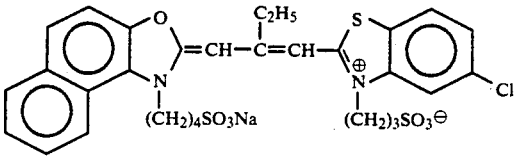

-continued
S-8
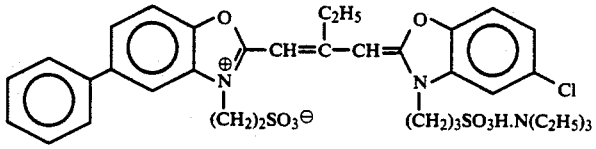
D-1
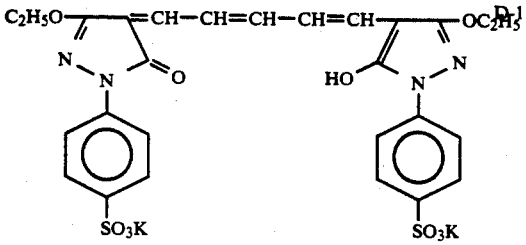
D-2
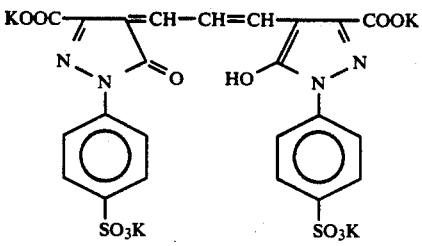
D-3
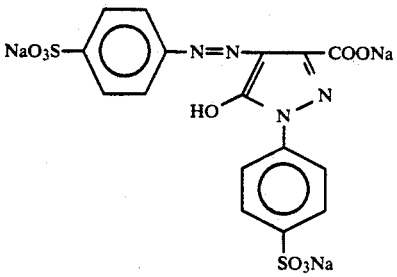
D-4
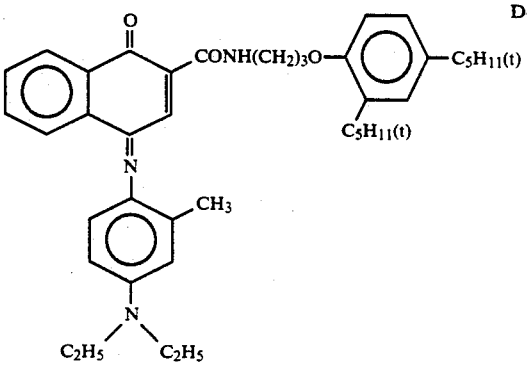
H-1
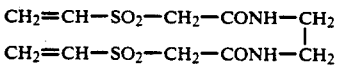
W-1
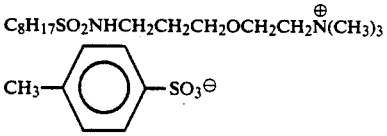
W-2
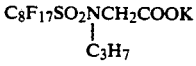
W-3
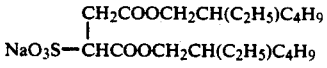
W-4
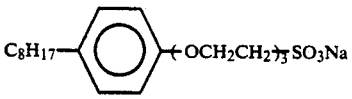
P-1
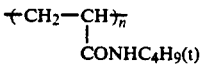
M-1
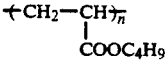
F-1
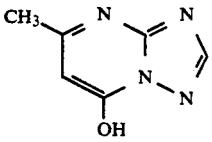
F-2
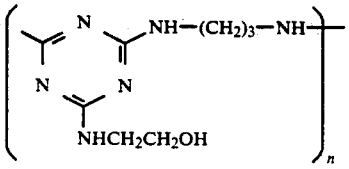
$\cdot HNO_3$
F-3
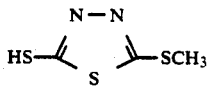

-continued

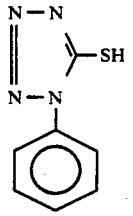

F-4

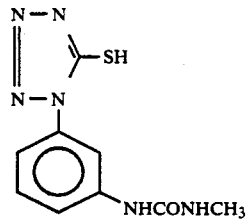

F-5

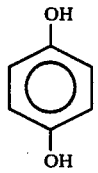

F-6

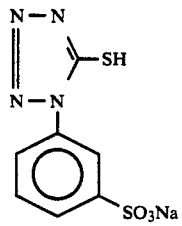

F-7

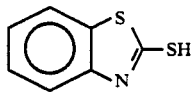

F-8

Thus, the layers were coated to prepare the following Samples 31 to 36.

Sample 31 was prepared by replacing the antistatic agent contained in the second layer provided on the back side with the same weight of gelatin. Samples 32 to 36 were prepared by using the antistatic agents shown in Table 7, which are identified in the same manner as in Example 1.

These samples were subjected to measurements of the antistatic property, swelling rate and layer strength and the transportation test as in Example 1.

The samples were processed by the processing methods (B) and (C) to evaluate the elution trace.

| Processing Step | Processing method (B) Time (min) | Temperature (°C.) | Tank capacity (l) | Replenishing amount (ml/m²) |
|---|---|---|---|---|
| 1st developing | 6 | 38 | 12 | 2200 |
| 1st rinsing | 2 | 38 | 4 | 7500 |
| Reversal | 2 | 38 | 4 | 1100 |
| Color developing | 6 | 38 | 12 | 2200 |
| Controlling | 2 | 38 | 4 | 1100 |
| Bleaching | 6 | 38 | 12 | 220 |
| Fixing | 4 | 38 | 8 | 1100 |
| 2nd rinsing | 4 | 38 | 8 | 7500 |
| Stabilizing | 1 | 25 | 2 | 1100 |

The compositions of the respective processing solutions are shown below:

| First developing solution | Tank Soln. | Replenishing Soln. |
|---|---|---|
| Pentasodium nitrilo-N,N,N-trimethylenephosphonate | 2.0 g | 2.0 g |
| Sodium sulfite | 30 g | 30 g |
| Hydroquinone potassium monosulfonate | 20 g | 20 g |
| Potassium carbonate | 33 g | 33 g |
| 1-Phenyl-4-methyl-4-hydroxymethyl-3-pyrazolidone | 2.0 g | 2.0 g |
| Potassium bromide | 2.5 g | 1.4 g |
| Potassium thiocyanate | 1.2 g | 1.2 g |

-continued

| First developing solution | Tank Soln. | Replenishing Soln. |
|---|---|---|
| Potassium iodide | 2.0 mg | — |
| Water was added to make | 1000 ml | 1000 ml |
| pH | 9.6 | 9.6 |

The pH was adjusted with hydrochloric acid or potassium hydroxide.

| Reversal solution | Tank soln./replenishing solution (common) |
|---|---|
| Pentasodium nitrilo-N,N,N-trimethylenephosphonate | 3.0 g |
| Stannous chloride dihydrate | 1.0 g |
| p-Aminophenol | 0.1 g |
| Sodium hydroxide | 8 g |
| Glacial acetic acid | 15 ml |
| Water was added to make | 1000 ml |
| pH | 6.00 |

The pH was adjusted with hydrochloric acid or sodium hydroxide.

| Color developing solution | Tank Soln. | Replenishing Soln. |
|---|---|---|
| Pentasodium nitrilo-N,N,N-trimethylenephosphonate | 2.0 g | 2.0 g |
| Sodium sulfite | 70 g | 70 g |
| Trisodium phosphate 12 hydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-(β-methanesulfonamidethyl)-3-methyl-4-aminoaniline sulfate | 11 g | 11 g |
| 3,6-Dithiaoctane-1,8-diol | 1.0 g | 1.0 g |
| Water was added to make | 1000 ml | 1000 ml |

-continued

| Color developing solution | Tank Soln. | Replenishing Soln. |
|---|---|---|
| pH | 11.80 | 12.00 |

The pH was adjusted with hydrochloric acid or potassium hydroxide.

| Controlling solution | Tank soln./replenishing solution (common) |
|---|---|
| Disodium ethylenediamine tetracetate dihydrate | 8.0 g |
| Sodium sulfite | 12 g |
| 1-Thioglycerine | 0.4 ml |
| Water was added to make | 1000 ml |
| pH | 6.20 |

The pH was adjusted with hydrochloric acid or sodium hydroxide.

| Bleaching solution | Tank Soln. | Replenishing Soln. |
|---|---|---|
| Disodium ethylenediaminetetracetate dihydrate | 2.0 g | 4.0 g |
| Ferric ammonium ethylenediaminetetracetate dihydrate | 120 g | 240 g |
| Potassium bromide | 100 g | 200 g |
| Ammonium nitrate | 10 g | 20 g |
| Water was added to make | 1000 ml | 1000 ml |
| pH | 5.70 | 5.50 |

The pH was adjusted with hydrochloric acid or sodium hydroxide.

| Fixing solution | Tank soln./replenishing solution (common) |
|---|---|
| Ammonium thiosulfate | 80 g |
| Sodium sulfite | 5.0 g |
| Sodium bisulfite | 5.0 g |
| Water was added to make | 1000 ml |
| pH | 6.60 |

The pH was adjusted with hydrochloric acid or ammonia water.

| Stabilizing solution | Tank soln./replenishing solution (common) |
|---|---|
| Formalin (37%) | 5.0 ml |
| Polyoxyethylene-p-monononylphenyl ether (average polymerization degree: 10) | 0.5 ml |
| Water was added to make | 1000 ml |
| pH | not adjusted |

Processing method (C)

| Processing Step | Time (min) | Temperature (°C.) | Tank capacity (l) | Replenishing amount (ml/m$^2$) |
|---|---|---|---|---|
| 1st developing | 6 | 38 | 12 | 2200 |
| 1st rinsing | 2 | 18 | 4 | 7500 |
| Reversal | 2 | 38 | 4 | 1100 |
| Color developing | 6 | 38 | 12 | 2200 |
| Controlling | 2 | 38 | 4 | 1100 |
| Bleaching | 6 | 38 | 12 | 220 |
| Fixing | 4 | 38 | 8 | 1100 |
| 2nd rinsing | 4 | 18 | 8 | 7500 |
| Stabilizing | 1 | 25 | 2 | 1100 |

The compositions of the respective processing solutions were the same as those in the processing method (B).

In the processing methods (B) and (C), the rinsing water was the same as used in the processing method (A) in Example 1.

The results are shown in Table 7.

TABLE 7

| Sample No. | Antistatic agent | Coated amount (g/m$^2$) | Antistatic property: Surface resistivity (Ω) | Antistatic property: Static marking | Swelling rate*1 | Transportation test | Elution trace Processing B | Elution trace Processing C | Layer strength (g) |
|---|---|---|---|---|---|---|---|---|---|
| 31 (Comp.) | — | 0 | $1.1 \times 10^{14}$ | C | 2.0 | C | A | A | 80 |
| 32 (Inv.) | Polymer 1 + Polymer 4 | 0.30 + 2.66 | $3.3 \times 10^{11}$ | A | 3.9 | A | A | A | 48 |
| 33 (Inv.) | Polymer 2 + Polymer 4 | 0.44 + 2.52 | $3.8 \times 10^{11}$ | A | 3.9 | A | A | A | 45 |
| 34 (Inv.) | Polymer 3 + Polymer 4 | 0.74 + 2.22 | $3.5 \times 10^{11}$ | A | 3.8 | A | A | A | 53 |
| 35 (Comp.) | Comp. Polymer A | 2.96 | $2.1 \times 10^{11}$ | A | 3.8 | A | B | C | 44 |
| 36 (Comp.) | Comp. Polymer B | 2.96 | $2.3 \times 10^{11}$ | A | 3.6 | A | B | C | 50 |

*1Swelling rate of the back layer.

It has been found that Samples 32 to 34 had an excellent antistatic property, swelling rate and layer strength, similar to the invention samples in Example 1. Curling did not take place, while processing and the transportation test showed good results as well. Further, in the measurement of the elution trace, the combination of the compounds of the present invention provided significantly better results than the comparative compounds A and B. This shows that the compounds of the present invention provide excellent performance regardless of the level of the fluctuation of the processing conditions.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having provided thereon at least one light-sensitive silver halide emulsion layer, wherein the material contains an anionic crosslinked polymer dispersion containing a polymer represented by Formula (I), and the material further contains an anionic water soluble polymer represented by Formula (II):

Formula (I)

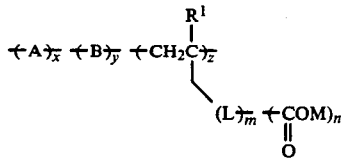

Formula (II)

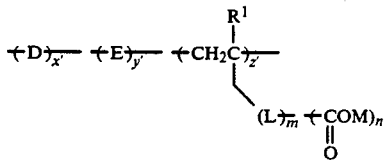

wherein A represents a repetitive unit formed by copolymerizing a crosslinking monomer having at least two copolymerizable ethylenically unsaturated groups; B and E each represent a monomer unit formed by copolymerizing copolymerizable ethylenically unsaturated monomers; $R^1$ represents a hydrogen atom, a substituted or unsubstituted lower alkyl group, or a halogen atom; L represents a di- to tetravalent linkage group; M represents a hydrogen atom or a cation; m represents 0 or 1; n represents 1, 2 or 3; D represents a monomer unit formed by copolymerizing at least one monomer selected from the group consisting of N,N-dimethylacrylamide, N-acryloylmorpholine, and N-acryloylpiperidine; x, y, z, x', y' and z' each represent a percentage of a monomer component, provided that x is from 1 to 70, y is from 0 to 50, and z is from 25 to 90, x' is from 1 to 99, y' is from 0 to 50, and z' is from 1 to 99, wherein $x+y+z=100$ and $x'+y'+z'=100$;

wherein the polymers represents by Formula (I) and Formula (II) are present in a ratio of from 60 to 99% by weight for the polymer of Formula (I), based on the sum of the weights of the polymers represented by Formula (I) and Formula (II); and wherein the polymers represented by Formula (I) and Formula (II) are present in a total amount of from 0.1 to 20 g per $m^2$ of the light-sensitive material.

2. A light-sensitive material of claim 1, wherein the polymers represented by Formula (I) and Formula (II) are contained in a layer provided on the support on the side opposite to the silver halide emulsion layer.

3. A light-sensitive material of claim 1, wherein the polymer represented by Formula (I) is prepared by copolymerizing at least two kinds of polymerizable monomers, including a copolymerizable ethylenically unsaturated monomer having at least one anionic functional group and a crosslinking monomer having at least two copolymerizable ethylenically unsaturated groups, in an aqueous medium in the presence of a polymerization initiator.

4. A light-sensitive material of claim 1, wherein A represents a repetitive unit provided by a copolymerizable ethylenically unsaturated monomer selected from the group consisting of divinylbenzene and ethylene glycol dimethacrylate.

5. A light-sensitive material of claim 1, wherein M is an alkali metal ion.

6. A light-sensitive material of claim 1, wherein E represents a monomer which is soluble in distilled water.

7. A light-sensitive material of claim 1, wherein x is from 10 to 60, y is from 0 to 30, z is from 50 to 90, x' is from 5 to 95, y' is from 0 to 30, and z' is from 5 to 95.

8. A light-sensitive material of claim 1, wherein the total amount of the polymers represented by Formula (I) and Formula (II) is from 1 to 5 g per $m^2$ of the light-sensitive material.

9. A light-sensitive material of claim 1, wherein the polymers represented by Formula (I) and Formula (II) are contained in an antistatic layer in an amount of from 10 to 90% by weight, based on the total weight of the antistatic layer.

10. A light-sensitive material of claim 1, wherein gelatin is contained in an antistatic layer in an amount of from 10 to 90% by weight, based on the total weight of the antistatic layer.

* * * * *